US008168146B2

(12) United States Patent
Hobson et al.

(10) Patent No.: US 8,168,146 B2
(45) **Date of Patent: *May 1, 2012**

(54) PROCESS FOR PREPARING HIGH CONCENTRATION DISPERSIONS OF LITHIUM HYDROXIDE MONOHYDRATE AND OF ANHYDROUS LITHIUM HYDROXIDE OILS

(75) Inventors: David M. Hobson, Belper (GB); Alex F. Psaila, Caterham (GB)

(73) Assignee: The Lubrizol Corporation, Wickliffe, OH (US)

( * ) Notice: Subject to any disclaimer, the term of this patent is extended or adjusted under 35 U.S.C. 154(b) by 1186 days.

This patent is subject to a terminal disclaimer.

(21) Appl. No.: 11/557,612

(22) Filed: Nov. 8, 2006

(65) Prior Publication Data

US 2008/0108529 A1 May 8, 2008

(51) Int. Cl.
*C01D 1/00* (2006.01)
*C01D 1/32* (2006.01)
*B21C 9/02* (2006.01)

(52) U.S. Cl. ..... 423/184; 508/163; 508/164

(58) Field of Classification Search ..... 508/163, 508/164; 423/184

See application file for complete search history.

(56) References Cited

U.S. PATENT DOCUMENTS

| | | | | |
|---|---|---|---|---|
| 4,708,753 | A | 11/1987 | Forsberg | 149/2 |
| 5,236,607 | A | 8/1993 | Harris et al. | |
| 5,314,982 | A * | 5/1994 | Rasp et al. | 528/48 |
| 2003/0069144 | A1 * | 4/2003 | Iso | 508/182 |
| 2005/0169833 | A1 * | 8/2005 | Spitler et al. | 423/594.15 |

FOREIGN PATENT DOCUMENTS

| | | | |
|---|---|---|---|
| WO | WO 2004/031328 | A2 | 4/2004 |
| WO | WO 2005/097952 | A1 | 10/2005 |

* cited by examiner

*Primary Examiner* — Walter D Griffin
*Assistant Examiner* — Vishal Vasisth
(74) *Attorney, Agent, or Firm* — Christopher D. Hilker; David M. Shold

(57) ABSTRACT

The disclosed technology relates to a dispersion comprising LiOH and/or $LiOH.H_2O$ particulates dispersed in an organic medium comprising at least one oil and at least one surfactant, the concentration of LiOH and/or $LiOH.H_2O$ particulates in the dispersion being greater than 10% by weight, the LiOH and/or $LiOH.H_2O$ particulates having a mean particle size in the range up to about 10 microns wherein at least about 99% by weight of the LiOH particulates have a particle size in the range up to about 20 microns. A process for making the dispersion is disclosed. Grease compositions made using the dispersion are disclosed.

12 Claims, No Drawings

PROCESS FOR PREPARING HIGH CONCENTRATION DISPERSIONS OF LITHIUM HYDROXIDE MONOHYDRATE AND OF ANHYDROUS LITHIUM HYDROXIDE OILS

TECHNICAL FIELD

The disclosed technology relates to anhydrous lithium hydroxide and/or lithium hydroxide monohydrate dispersions, processes for making the dispersions, and grease compositions made from the dispersions.

BACKGROUND

Anhydrous lithium hydroxide (LiOH) and lithium hydroxide monohydrate ($LiOH.H_2O$) may be used for making grease. However, they are normally insoluble in oil. Dispersions containing either or both of these having a low solids content (i.e. the amount of LiOH and/or $LiOH.H_2O$ in the dispersion), typically up to 10 wt %, may be used. However, these solids dispersions contain large amounts of a carrier medium (often an oil of lubricating viscosity) which makes transportation, storage, and dispensing of the dispersions problematic due to the volume of the medium. This also makes low solids dispersions less environmentally friendly and more expensive. The problem, therefore, is to provide a stable, high solids content dispersion of LiOH and/or $LiOH.H_2O$ which may be used for making grease.

The disclosed technology provides a solution to this problem.

SUMMARY

The disclosed technology relates to a dispersion comprising LiOH and/or $LiOH.H_2O$ particulates dispersed in an organic medium, the organic medium comprising at least one oil and at least one surfactant, the concentration of LiOH and/or $LiOH.H_2O$ particulates in the dispersion being greater than 10% by weight, the LiOH and/or $LiOH.H_2O$ particulates having a mean particle size in the range up to about 10 microns wherein at least about 99% by weight of the LiOH and/or $LiOH.H_2O$ particulates have a particle size in the range up to about 20 microns. The dispersion may be referred to as a stable, high solids dispersion.

The disclosed technology further relates to a grease composition made by mixing the foregoing dispersion with at least one carboxylic acid and/or ester thereof and at least one oil of lubricating viscosity, and reacting the LiOH and/or $LiOH.H_2O$ particulates with the carboxylic acid and/or ester thereof sufficiently to thicken the oil of lubricating viscosity to a grease consistency.

The disclosed technology further relates to a process for making a dispersion comprising LiOH particulates, the process comprising: (A) forming a slurry comprising $LiOH.H_2O$ solids and an organic medium, the organic medium comprising at least one oil and at least one surfactant; (B) milling the slurry to form a dispersion comprising $LiOH.H_2O$ particulates dispersed in the organic medium; and (C) dehydrating the dispersion to convert the $LiOH.H_2O$ particulates to LiOH particulates. This process may further comprise: (D) mixing $LiOH.H_2O$ solids with the dispersion of LiOH particulates formed in (C) to form a dispersion mixture; (E) milling the dispersion mixture to form a second disperson comprising LiOH and $LiOH.H_2O$ particulates; and (F) dehydrating the second dispersion to convert the $LiOH.H_2O$ particulates in the second dispersion to LiOH particulates. The weight ratio of $LiOH.H_2O$ solids to LiOH particulates in step (D) may be in the range from about 9.2:1 to about 0.2:1, and in one embodiment in the range from about 1.1:1 to about 0.65:1.

The disclosed technology further relates to a process for making a dispersion comprising LiOH particulates, the process comprising: forming a slurry comprising $LiOH.H_2O$ solids, mineral oil and polyisobutenyl succinic acid and/or anhydride; milling the slurry to form a dispersion comprising $LiOH.H_2O$ particulates dispersed in the mineral oil and the polyisobutenyl succinic acid and/or anhydride; and dehydrating the dispersion to convert the $LiOH.H_2O$ particulates to LiOH particulates, the LiOH particulates having a mean particle size in the range up to about 1 micron wherein at least about 70% by weight of the particulates have a particle size in the range up to about 2 microns, and at least about 99% by weight of the particulates have a particle size in the range up to about 10 microns.

The disclosed technology further relates to a process for making a dispersion comprising $LiOH.H_2O$ particulates, the process comprising: forming a slurry comprising $LiOH.H_2O$ solids and an organic medium, the organic medium comprising at least one oil and at least one surfactant; and milling the slurry to form a dispersion comprising $LiOH.H_2O$ particulates dispersed in the organic medium.

The disclosed technology further relates to a process for making grease comprising: forming a slurry comprising $LiOH.H_2O$ solids and an organic medium, the organic medium comprising at least one oil and at least one surfactant; milling the slurry to form a dispersion comprising $LiOH.H_2O$ particulates dispersed in the organic medium; dehydrating the dispersion to convert the $LiOH.H_2O$ particulates to LiOH particulates; and mixing the dispersion with at least one carboxylic acid and/or ester thereof and at least one oil of lubricating viscosity, and reacting the LiOH particulates with the carboxylic acid and/or ester thereof sufficiently to thicken the oil of lubricating viscosity to a grease consistency.

The disclosed technology further relates to a process for making grease, comprising: forming a slurry comprising $LiOH.H_2O$ solids and an organic medium, the organic medium comprising at least one oil and at least one surfactant; milling the slurry to form a dispersion comprising $LiOH.H_2O$ particulates dispersed in the organic medium; and mixing the dispersion with at least one carboxylic acid and/or ester thereof and at least one oil of lubricating viscosity, and reacting the $LiOH.H_2O$ particulates with the carboxylic acid and/or ester thereof sufficiently to thicken the oil of lubricating viscosity to a grease consistency.

DETAILED DESCRIPTION

The term "slurry" may be used herein to refer to a mixture of solids (e.g., lithium hydroxide monohydrate solids) and an organic medium (e.g., an oil or a mixture of an oil and one or more surfactants).

The term "dispersion" may be used herein to refer to a liquid medium (e.g., an organic medium comprising an oil, a mixture of oil and one or more surfactants, etc.) with individual solid particulates (e.g., anhydrous lithium hydroxide particulates) generally separated from one another and being reasonably evenly distributed throughout the liquid medium.

The term "stable dispersion" may be used herein to refer to a dispersion wherein less than about 1% by weight of the solids drop out of the dispersion after 60 days, and in one embodiment after 240 days, when the dispersion is maintained at 20° C. without agitation.

The term "high solids dispersion" may be used herein to refer to a dispersion with a lithium content of at least about 1.5% by weight, and in one embodiment at least about 3% by weight, and in one embodiment at least about 5% by weight, and in one embodiment at least about 7% by weight, and in one embodiment at least about 10% by weight up to about 20% by weight and in one embodiment up to about 18% by weight. In one embodiment the concentration of lithium may be in the range from about 1.5 to about 20% by weight, and in one embodiment in the range from about 3% to about 18% by weight. The term "high solids dispersion" may be used to refer to a dispersion containing greater than 10% by weight LiOH and/or $LiOH.H_2O$ particulates, and in one embodiment at least about 12% by weight LiOH and/or $LiOH.H_2O$ particulates, and in one embodiment at least about 15% by weight LiOH and/or $LiOH.H_2O$ particulates, and in one embodiment at least about 20% by weight LiOH and/or $LiOH.H_2O$ particulates, and in one embodiment at least about 25% by weight LiOH and/or $LiOH.H_2O$ particulates, and in one embodiment at least about 30% by weight LiOH and/or $LiOH.H_2O$ particulates, and in one embodiment at least about 35% by weight LiOH and/or $LiOH.H_2O$ particulates, and in one embodiment at least about 40% by weight LiOH and/or $LiOH.H_2O$ particulates. The concentration of LiOH and/or $LiOH.H_2O$ particulates may be up to about 62% by weight, and in one embodiment up to about 60% by weight, and in one embodiment up to about 55% by weight, and in one embodiment up to about 50% by weight, and in one embodiment up to about 45% by weight, and in one embodiment up to about 40% by weight.

The term "hydrocarbyl," when referring to groups attached to the remainder of a molecule, may be used herein to refer to groups having a purely hydrocarbon or predominantly hydrocarbon character within the context of this invention. These groups include the following:

(1) Purely hydrocarbon groups; that is, aliphatic, alicyclic, aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Examples include methyl, octyl, cyclohexyl, phenyl, etc.

(2) Substituted hydrocarbon groups; that is, groups containing non-hydrocarbon substituents which do not alter the predominantly hydrocarbon character of the group. Examples include hydroxy, nitro, cyano, alkoxy, acyl, etc.

(3) Hetero groups; that is, groups which, while predominantly hydrocarbon in character, contain atoms other than carbon in a chain or ring otherwise composed of carbon atoms. Examples include nitrogen, oxygen and sulfur.

In general, no more than about three substituents or hetero atoms, and in one embodiment no more than one, may be present for each 10 carbon atoms in the hydrocarbyl group.

The term "lower" may be used herein in conjunction with terms such as hydrocarbyl, alkyl, alkenyl, alkoxy, and the like, may describe such groups which contain a total of up to 7 carbon atoms.

The term "oil-soluble" may be used herein to refer to a material that is soluble in mineral oil to the extent of at least about 0.5 gram per liter at 25° C.

The term "insoluble" may be used herein to refer to a material that is insoluble in mineral oil at 25° C. or is soluble in mineral oil at 25° C. to the extent of up to about 0.5 gram per liter.

The term "TBN" may be used herein to refer to total base number. This is the amount of acid (perchloric or hydrochloric) needed to neutralize all or part of a material's basicity, expressed as milligrams of KOH per gram of sample.

The term "soap" may be used herein to refer to the reaction product of lithium with a carboxylic acid and/or ester thereof.

The dispersion that may be provided in accordance with the disclosed technology may be a high solids dispersion which comprises anhydrous lithium hydroxide (LiOH) and/or lithium hydroxide monohydrate ($LiOH.H_2O$) particulates dispersed in an organic medium. The organic medium may comprise at least one oil and at least one surfactant. The LiOH and/or $LiOH.H_2O$ particulates may have a mean particle size in the range up to about 10 microns, and in one embodiment in the range from about 20 nanometers (nm) to about 10 microns, and in one embodiment in the range from about 20 nm to about 5 microns, and in one embodiment in the range from about 20 nm to about 1 micron, and in one embodiment in the range from about 20 to about 900 nm, and in one embodiment in the range from about 20 to about 600 nm, and in one embodiment in the range from about 20 to about 300 nm. At least about 70% by weight, and in one embodiment at least about 80% by weight, and in one embodiment at least about 90% by weight, and in one embodiment at least about 95% by weight of the LiOH and/or $LiOH.H_2O$ particulates may have a particle size up to about 20 microns, and in one embodiment up to about 10 microns, and in one embodiment up to about 1 micron. Up to about 100% by weight, and in one embodiment at least about 99% by weight, and in one embodiment at least about 97% by weight, and in one embodiment at least about 95% by weight of the LiOH and/or $LiOH.H_2O$ particulates may have a particle size in the range up to about 20 microns, and in one embodiment up to about 15 microns, and in one embodiment up to about 10 microns, and in one embodiment up to about 5 microns, and in one embodiment up to about 3 microns, and in one embodiment up to about 2 microns. The dispersion may have a TBN in the range from about 130 to about 1600, and in one embodiment in the range from about 500 to about 900.

The oil that may be used in the dispersion may comprise one or more oils of lubricating viscosity, including natural oils, synthetic lubricating oils, and mixtures thereof. The oil may be produced by gas-to-liquid processes such as Fischer-Tropsch reactions. The oil may comprise one or more poly alphaolefins.

The natural oils may include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types. The oils may be biodegradable oils, for example, natural oils such as vegetable oils which are biodegradable. Oils of lubricating viscosity derived from coal or shale may be useful. Synthetic lubricating oils that may be useful may include hydrocarbon oils such as polymerized and interpolymerized olefins (e.g., polybutylenes, polypropylenes, propyleneisobutylene copolymers,); poly(1-hexenes), poly(1-octenes), poly(1-decenes), and mixtures thereof; alkyl-benzenes (e.g., dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulfides and the derivatives, analogs and homologs thereof.

Alkylene oxide polymers and interpolymers and derivatives thereof where the terminal hydroxyl groups have been modified by esterification, and etherification, constitute another class of synthetic lubricating oils that may be used. These may be exemplified by the oils prepared through polymerization of ethylene oxide or propylene oxide, the alkyl and aryl ethers of these polyoxyalkylene polymers (e.g., methyl-polyisopropylene glycol ether having a number average molecular weight of 1000, diphenyl ether of polyethylene glycol having a molecular weight of 500-1000, diethyl ether of polypropylene glycol having a molecular weight of 1000-1500) or mono- and polycarboxylic esters thereof, for example, the acetic acid esters, mixed $C_{3-8}$ fatty acid esters, or the $C_{13}$ Oxo acid diester of tetraethylene glycol.

Another class of synthetic lubricating oils that may be used may comprise the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, and alkenyl malonic acids) with a variety of alcohols (e.g., butyl alcohol, hexyl alcohol, dodecyl alcohol, 2-ethylhexyl alcohol, ethylene glycol, diethylene glycol monoether, and propylene glycol) Specific examples of these esters include dibutyl adipate, di-(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters that may be useful may include synthetic oils made from $C_5$ to $C_{22}$ monocarboxylic acids and polyols such as neopentyl glycol, trimethylol propane, and pentaerythritol, or polyol ethers such as dipentaerythritol, and tripentaerythritol. Other examples of these types of esters may include biobased esters such as mixed fatty acid and complex esters of trimethyolpropane and/or neopentyl glycol.

Silicon-based oils such as the polyalkyl-, polyaryl-, polyalkoxy-, or polyaryloxy-siloxane oils and silicate oils may comprise another useful class of synthetic lubricating oils (e.g., tetraethyl silicate, tetraisopropyl silicate, tetra-(2-ethylhexyl)silicate, tetra-(4-methylhexyl)silicate, tetra-(p-tert-butylphenyl) silicate, hexyl-(4-methyl-2-pentoxy)disiloxane, poly(methyl)siloxanes, and poly-(methylphenyl)siloxanes). Other synthetic lubricating oils may include liquid esters of phosphorus-containing acids (e.g., tricresyl phosphate, trioctyl phosphate, and the diethyl ester of decane phosphonic acid), and polymeric tetrahydrofurans.

The polyalphaolefins (PAOs) may be derived from monomers having from about 4 to about 30 carbon atoms, and in one embodiment from about 4 to about 20, and in one embodiment from about 6 to about 16 carbon atoms. Examples of useful PAOs may include those derived from 1-hexene, 1-octene, 1-decene, or a mixture of two or more thereof. These PAOs may have a viscosity in the range from about 1.5 to about 150 $mm^2/s$ (cSt) at 100° C. The PAOs may comprise hydrogenated hydrocarbons.

Unrefined, refined and re-refined oils, either natural or synthetic (as well as mixtures of two or more of any of these) of the type disclosed hereinabove may be used. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, and the like. Re-refined oils may be obtained by processes similar to those used to obtain refined oils applied to refined oils which have been already used in service. The re-refined oils may also be known as reclaimed or reprocessed oils and often are additionally processed by techniques directed to removal of spent additives and oil breakdown products.

Oils of lubricating viscosity that may be used may be defined as specified in the American Petroleum Institute (API) Base Oil Interchangeability Guidelines. The five base oil groups are as follows:

| Base Oil Category | Sulphur (%) | | Saturates (%) | Viscosity Index |
|---|---|---|---|---|
| Group I | >0.03 | and/or | <90 | 80-120 |
| Group II | ≦0.03 | and | ≧90 | 80-120 |
| Group III | ≦0.03 | and | ≧90 | ≧120 |
| Group IV | All polyalphaolefins (PAOs) | | | |
| Group V | All others not included in Groups I, II, III, or IV | | | |

Groups I, II, and III are mineral oil base stocks. The oil of lubricating viscosity may be a Group I, II, III, IV or V oil, or a mixture of two or more thereof.

The surfactants that may be used may comprise one or more ionic and/or non-ionic compounds. The ionic compounds may be cationic and/or anionic compounds. These compounds may have a hydrophilic lipophilic balance (HLB) up to about 20, and in one embodiment in the range from about 1 to about 18, and in one embodiment in the range from about 1 to about 14, and in one embodiment in the range from about 1 to about 10, and in one embodiment in the range from about 1 to about 8, and in one embodiment in the range from about 2.5 to about 6.

Examples of surfactants that may be used are disclosed in *McCutcheon's Emulsifiers and Detergents*, 1993, North American & International Edition. Examples may include alkanolamides, alkylarylsulphonates, amine oxides, poly (oxyalkylene) compounds, including block copolymers comprising alkylene oxide repeat units (e.g., Pluronic™), carboxylated alcohol ethoxylates, ethoxylated alcohols, ethoxylated alkyl phenols, ethoxylated amines and amides, ethoxylated fatty acids, ethoxylated fatty esters and oils, fatty esters, glycerol esters, glycol esters, imidazoline derivatives, lecithin and derivatives, lignin and derivatives, monoglycerides and derivatives, olefin sulphonates, phosphate esters and derivatives, propoxylated and ethoxylated fatty acids or alcohols or alkyl phenols, sorbitan derivatives, sucrose esters and derivatives, sulphates or alcohols or ethoxylated alcohols or fatty esters, polyisobutylene succinicimide and derivatives, sulphonates of dodecyl and tridecyl benzenes or condensed naphthalenes or petroleum, sulphosuccinates and derivatives, tridecyl and dodecyl benzene sulphonic acids, and mixtures of two or more thereof.

The surfactant may comprise an alkylated benzene sulphonate of an alkali metal or alkaline earth metal. The alkyl group may contain from about 8 to about 20 carbon atoms, and in one embodiment from about 10 to about 15 carbon atoms. The alkyl group may be dodecyl. The alkali metal may be lithium, potassium or sodium. The alkaline earth metal may be calcium or magnesium. The surfactant may comprise one or more derivatives of a polyolefin. The polyolefins may include polyisobutylene; polypropylene; polyethylene; a copolymer derived from isobutene and butadiene; a copolymer derived from isobutene and isoprene; or mixtures of two or more thereof.

The polyolefin may be a derivative of polyisobutylene with a number average molecular weight of at least about 250, 300, 500, 600, 700, or 800, to about 5000 or more, often up to about 3000, 2500, 1600, 1300, or 1200. The polyolefin may be reacted with maleic anhydride to make a succinic anhydride or succinic acid derivative (hereinafter succinic may be abbreviated as "succan") that may be further reacted with polar groups such as an alkali metal, alcohol, alkanol amine, or amine to form a larger hydrophilic group on the surfactant. This type of surfactant is disclosed in U.S. Pat. No. 4,708,753. In one embodiment, less than about 5% by weight of the polyisobutylene used to make the succan derivative molecules may have an $\overline{M}_n$ that is less than about 250. The polyisobutylene used to make the succan derivative may have an $\overline{M}_n$ of at least about 700. The polyisobutylene used to make the succan derivative may contain at least about 30% terminal vinylidene groups, and in one embodiment at least about 60%, and in one embodiment at least about 75% or at least about 85% terminal vinylidene groups. The polyisobutylene used to make the succan derivative may have a polydispersity, $\overline{M}_w/\overline{M}_n$, greater than about 5, and in one embodiment from about 6 to about 20.

The polyisobutylene substituent of the polyisobutylene that is substituted with succinic acid or anhydride may have a number average molecular weight in the range from about 700 to about 3000, and in one embodiment in the range from about 1,500 to about 3,000, and in one embodiment in the range from about 1,800 to about 2,300, and in one embodiment in the range from about 700 to about 1300, in one embodiment about 800 to about 1000. The polyisobutylene-substituted succinic acid or anhydride may be characterized by about 1.0 to about 2.5, and in one embodiment about 1.3 to about 2.5, and in one embodiment about 1.7 to about 2.1, and in one embodiment about 1.0 to about 1.3, and in one embodiment about 1.0 to about 1.2 succinic groups per equivalent weight of the polyisobutylene substituent.

The surfactant may comprise a polyisobutenyl-dihydro-2,5-furandione ester with pentaerythritol. The surfactant may comprise a polyolefin amino ester, an alkyl benzene sulfonic acid, a polyisobutenyl succinic acid, a polyisobutenyl succinic anhydride and/or a propylamine ethoxylate.

The dispersion may comprise greater than 10% by weight of the LiOH and/or $LiOH.H_2O$ particulates, and in one embodiment at least about 12% by weight LiOH and/or $LiOH.H_2O$ particulates, and in one embodiment from about 12 to about 62% by weight LiOH and/or $LiOH.H_2O$ particulates, and in one embodiment from about 12 to about 60 percent by weight LiOH and/or $LiOH.H_2O$ particulates, and in one embodiment from about 12 to 50% by weight LiOH and/or $LiOH.H_2O$ particulates, and in one embodiment from about 12 to about 45% by weight LiOH and/or $LiOH.H_2O$ particulates, and in one embodiment from about 12 to about 40% by weight LiOH and/or $LiOH.H_2O$ particulates. The dispersion may comprise greater than 10% by weight of the LiOH particulates, and in one embodiment at least about 12% by weight LiOH particulates, and in one embodiment from about 12 to about 62% by weight LiOH particulates, and in one embodiment from about 12 to about 60 percent by weight LiOH particulates, and in one embodiment from about 12 to 50% by weight LiOH particulates, and in one embodiment from about 12 to about 45% by weight LiOH particulates, and in one embodiment from about 12 to about 40% by weight LiOH particulates. The dispersion may contain lithium at a concentration in the range from about 1.5 to about 20% by weight, and in one embodiment from about 3 to about 18% by weight. The dispersion may comprise from about 30 to about 90% by weight oil, and in one embodiment from about 35 to about 65% by weight oil. The dispersion may comprise from about 1 to about 20% by weight surfactant, and in one embodiment from about 3 to about 12% by weight surfactant, and in one embodiment in the range from about 3 to about 6% by weight, and in one embodiment in the range from about 4 to about 12% by weight surfactant.

The dispersion may be prepared by a process comprising (A) forming a slurry comprising lithium hydroxide monohydrate ($LiOH.H_2O$) solids and an organic medium, the organic medium comprising at least one oil and at least one surfactant; and (B) milling the slurry to form a dispersion comprising $LiOH.H_2O$ particulates dispersed in the organic medium. The process may further comprise (C) dehydrating the $LiOH.H_2O$ particulates to form anhydrous lithium hydroxide (LiOH) particulates, the LiOH particulates being dispersed in the organic medium. The process may further comprise: (D) mixing $LiOH.H_2O$ solids with the dispersion of LiOH particulates formed in (C) to form a dispersion mixture; and (E) milling the dispersion mixture to form a second disperson comprising LiOH and $LiOH.H_2O$ particulates. The process may further comprise (F) dehydrating the $LiOH.H_2O$ particulates in the second dispersion to form LiOH particulates.

The lithium hydroxide monohydrate solids used in step (A) may have a mean particle size in the range from about 100 to about 1200 microns, and in one embodiment in the range from about 150 to about 500 microns. The solids may be initially provided in larger particle sizes and ground to the desired size.

The slurry may comprise a concentration of lithium hydroxide monohydrate solids in the range from about 10 to about 70% by weight, and in one embodiment in the range from about 30 to about 60% by weight, and in one embodiment in the range from about 40 to about 55% by weight. The slurry may contain from about 30 to about 90% by weight oil, and in one embodiment from about 35 to about 65% by weight oil. The slurry may contain from about 1 to about 20% by weight surfactant, and in one embodiment from about 4 to about 12% by weight surfactant.

The slurry may be converted to the desired dispersion by milling the slurry to reduce the size of the lithium hydroxide monohydrate solids and disperse the resulting particulates in the organic medium. Optionally, the dispersion may be dehydrated to convert the lithium hydroxide monohydrate particulates to anhydrous lithium hydroxide particulates.

The slurry may be milled using one or more media mills, ball mills, roller mills, attritors, disintegrators, microfluidizers, jet mills, ultrasonic mills and/or homogenizers. The media mills may comprise one or more bead mills, sand mills, pebble mills and/or pearl mills. The media mills may use media (e.g., beads) having average diameters in the range from about 0.3 to about 2.5 mm. In one embodiment, two sequential media (e.g., bead) mills may be used, one employing media (e.g., beads) with an average diameter in the range from about 1.5 to about 2.5 mm, and in one embodiment in the range from about 1.8 to about 2.2 mm, and in one embodiment about 2 mm; and the other media (e.g., bead) mill employing media (e.g., beads) having an average diameter in the range from about 0.3 to about 0.8 mm, and in one embodiment in the range from about 0.4 to about 0.7 mm, and in one embodiment about 0.5 mm. The milling may be performed in a single milling step using a media (e.g., bead) mill employing media (e.g., beads) with an average diameter in the range from about 0.8 to about 1.2 mm, and in one embodiment about 1.0 mm.

The dispersion formed from the foregoing milling step may then be dehydrated to convert the lithium hydroxide monohydrate ($LiOH.H_2O$) particulates to anhydrous lithium hydroxide (LiOH) particulates. The lithium hydroxide monohydrate particulates may be converted to anhydrous lithium hydroxide particles by heating the dispersion at a temperature in the range from about 80 to about 130° C., and in one embodiment in the range from about 90 to about 110° C. The pressure may be in the range from about 50 to about 500 millibars, and in one embodiment in the range from about 100 to about 300 millibars. This heating step may be conducted until the water content of the dispersion is less than about 0.5% by weight, and in one embodiment less than about 0.3% by weight, and in one embodiment less than about 0.1% by weight. The dehydration step may be conducted using one or more strippers, rotary evaporators, falling film evaporators, thin film evaporators, wiped film evaporators, short path evaporators and/or distillation units.

The dispersion containing LiOH and/or $LiOH.H_2O$ particulates may be used to form one or more grease compositions. The grease compositions may be made by mixing the dispersion with at least one carboxylic acid and/or ester thereof and at least one oil of lubricating viscosity, and reacting the anhydrous lithium hydroxide and/or lithium hydroxide monohydrate particulates with the carboxylic acid and/or ester thereof under conditions sufficient to thicken the oil of lubricating viscosity to a grease consistency. The oil of lubricating viscosity may be any of the oils of lubricating viscosity discussed above for use in forming the dispersions. The oil of lubricating viscosity may comprise at least one biodegradable oil (e.g., at least one biodegradable natural oil such as at least one biodegradable vegetable oil and/or at least one biobased ester derived from mixed fatty acids and neopentyl glycol and/or trimethylol propane), at least one polyalphaolefin, or a mixture of two or more thereof.

The carboxylic acid and/or ester thereof may comprise any mono- or poly- carboxylic acid and/or ester thereof, or a mixture of two or more thereof. The polycarboxylic acid and/or ester may be a di-carboxylic acid and/or ester thereof. The ester of the dicarboxylic acid may be a diester. The carboxylic acid and/or ester may comprise one or more branched alicyclic or linear, saturated or unsaturated, mono- or poly- hydroxy substituted or unsubstituted carboxylic acids and/or esters. The carboxylic acid may comprise one or more acid chlorides. The carboxylic acid ester may comprise one or more esters of one or more of the carboxylic acids with one or more alcohols. The alcohols may be alcohols of 1 to about 5 carbon atoms. The carboxylic acids may contain from 2 to about 30 carbon atoms per molecule, and in one embodiment from about 4 to about 30 carbon atoms, and in one embodiment from about 8 to about 27 carbon atoms, and in one embodiment from about 12 to about 24 carbon atoms, and in one embodiment from about 16 to about 20 carbon atoms. The carboxylic acid and/or ester thereof may comprise one or more monocarboxylic acids and/or esters thereof, one or more dicarboxylic acids and/or esters thereof, or a mixture of two or more thereof. The carboxylic acid may comprise an alkanoic acid. The carboxylic acid and/or ester thereof may comprise a mixture of one or more dicarboxylic acids and/or esters thereof and/or one or more polycarboxylic acids and/or esters thereof. The carboxylic acid and/or ester thereof may comprise a mixture of one or more monocarboxylic acids and/or ester thereof, and one or more dicarboxylic and/or polycarboxylic acids and/or esters thereof. The weight ratio of dicarboxylic and/or polycarboxylic acid and/or ester thereof to monocarboxylic acid and/or ester thereof may be in the range from about 15:85 to about 40:60, and in one embodiment from about 20:80 to about 35:65, and in one embodiment from about 25:75 to about 35:65, and in one embodiment about 30:70.

The carboxylic acid and/or ester thereof may comprise one or more hydroxystearic acids and/or esters of these acids. The acids may comprise 9-hydroxy stearic acid, 10-hydroxy stearic acid, 12-hydroxy stearic acid, or a mixture of two or more thereof. The esters may comprise one or more methyl esters or natural esters such as methyl 9-hydroxy stearate, methyl 10-hydroxy stearate, methyl 12-hydroxy stearate, hydrogenated castor bean oil, or a mixture of two or more thereof. The carboxylic acid may comprise capric acid, lauric acid, myristic acid, palmitic acid, arachidic acid, behenic acid and/or lignoceric acid. The carboxylic acid may comprise one or more of undecylenic acid, myristoleic acid, palmitoleic acid, oleic acid, gadoleic acid, elaidic acid, cis-eicosenoic acid, erucic acid, nervonic acid, 2,4-hexadieonic acid, linoleic acid, 12-hydroxy tetradecanoic acid, 10-hydroxy tetradecanoic acid, 12-hydroxy hexadecanoic acid, 8-hydroxy hexadecanoic acid, 12-hydroxy icosanic acid, 16-hydroxy icosanic acid 11,14-eicosadienoic acid, linolenic acid, cis-8,11,14-eicosatrienoic acid, arachidonic acid, cis-5,8,11,14,17-eicosapentenoic acid, cis-4,7,10,13,16,19-docosahexenoic acid, all-trans-retinoic acid, ricinoleic acid lauroleic acid, eleostearic acid, licanic acid, citronelic acid, nervonic acid, abietic acid, abscisic acid, or a mixture of two or more thereof. The carboxylic acid may comprise palmitoleic acid, oleic acid, linoleic acid, linolenic acid, licanic acid, eleostearic acid, or a mixture of two or more thereof.

The carboxylic acid may comprise iso-octanedioic acid, octanedioic acid, nonanedioic acid (azelaic acid), decanedioic acid (sebacic acid), undecanedioic acid, dodecanedioic acid, tridecanedioic acid, tetradecanedioic acid, pentadecanoic acid, or a mixture of two or more thereof. The carboxylic acid may comprise nonanedioic acid (azelaic acid). The carboxylic acid may comprise decanedioic acid (sebacic acid). The reactive carboxylic acid functional groups may be delivered by esters such as dimethyl adipate, dimethyl nonanedioate (Azelate), dimethyl decanedioate (sebacate), diethyl adipate, diethyl nonanedioate (azelate), diethyl decanedioate (diethyl sebacate), or mixtures of two or more thereof.

The grease composition may be made from a mixture comprising at least one oil of lubricating viscosity, at least one carboxylic acid and/or ester thereof and a dispersion of LiOH and/or $LiOH.H_2O$ particulates. The mixture may comprise from about 0.3 to about 9% by weight of the dispersion of LiOH and/or $LiOH.H_2O$ particulates, and in one embodiment from about 1.3 to about 3% by weight of the dispersion. The amount of carboxylic acid and/or ester used in this mixture may be in the range from about 1.4% to about 39% by weight, and in one embodiment in the range from about 2% to about 25% by weight, and in one embodiment in the range from about 3% to about 8% by weight. The grease composition may comprise from about 1.5 to about 40% by weight soap in the final grease composition, and in one embodiment from about 6 to about 13.5% by weight soap in the final grease composition.

The grease composition may be made by mixing the dispersion of LiOH and/or $LiOH.H_2O$ particulates, oil of lubricating viscosity and carboxylic acid and/or ester thereof at a temperature in the range from about 25° C. to about 220° C., and in one embodiment in the range from about 80° C. to about 180°C. The reaction may be conducted until the grease achieves a desired consistency. The penetration according to ASTM D217 may be in the range from about 6 to about 475 tenths of a millimeter, and in one embodiment from about 200 to about 320 tenths of a millimeter. The reaction time may be in the range from about 35 to about 75 minutes, and in one embodiment in the range from about 35 to about 55 minutes.

The grease composition may further comprise one or more metal deactivators, antioxidants, antiwear agents, rust inhibitors, viscosity modifiers, extreme pressure agents, or a mixture of two or more thereof.

The metal deactivators may comprise one or more derivatives of benzotriazole, benzimidazole, 2-alkyldithiobenzimidazoles, 2-alkyldithiobenzothiazoles, 2-(N,N-dialkyldithiocarbamoyl)-benzothiazoles, 2,5-bis(alkyl-dithio)-1,3,4-thiadiazoles, 2,5-bis(N,N-dialkyldithio-carbamoyl)-1,3,4-thiadiazoles, 2-alkyldithio-5-mercapto thiadiazoles or mixtures thereof.

The benzotriazole compounds may include hydrocarbyl substitutions at one or more of the following ring positions 1- or 2- or 4- or 5- or 6- or 7-benzotriazoles. The hydrocarbyl groups may contain from 1 to about 30 carbons, and in one embodiment from 1 to about 15 carbons, and in one embodiment from 1 to about 7 carbons. The metal deactivator may comprise 5-methylbenzotriazole.

The metal deactivator may be present in the grease composition at a concentration in the range up to about 5 percent by weight, and in one embodiment in the range about 0.0002 to about 2 percent by weight, and in one embodiment from about 0.001 to about 1 percent by weight.

The antioxidants may be selected from a variety of chemical types including phenate sulphides, phosphosulphurised terpenes, sulphurised esters, aromatic amines, and hindered phenols, or a mixture of two or more thereof.

The antioxidant may comprise one or more alkylated sterically hindered phenols. The alkyl groups may be branched or linear alkyl groups containing from 1 to about 24 carbon atoms, and in one embodiment about 4 to about 18 carbon atoms, and in one embodiment from about 4 to about 12 carbon atoms. The alkyl groups may be either straight chained or branched chained. The phenol may be a butyl substituted phenol containing two t-butyl groups. When the t-butyl groups occupy the 2- and the 6-positions, the phenol may be sterically hindered. Additionally the phenols may have additional substitution in the form of a hydrocarbyl, or a bridging group between two such aromatic groups. Bridging groups in the para position may include —$CH_2$— (methylene bridge) and —$CH_2OCH_2$— (ether bridge).

Another class of antioxidants that may be used comprises the diphenylamines. These compounds may be represented by the formula:

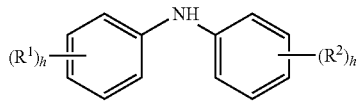

wherein $R^1$ and $R^2$ are independently hydrogen, an arylalkyl group or a linear or branched alkyl group containing from 1 to about 24 carbon atoms, and h is independently 0, 1, 2, or 3, provided that at least one aromatic ring contains an arylalkyl group or a linear or branched alkyl group. $R^1$ and $R^2$ may be alkyl groups containing from about 4 to about 20 carbon atoms. The diphenylamine may be mono- or di-nonylated diphenylamine.

The antioxidants may be present in the grease composition at a concentration up to about 12 weight percent, and in one embodiment in the range from about 0.1 to about 6 weight percent, and in one embodiment in the range from about 0.25 to about 3 weight percent.

The antiwear agent may comprise one or more metal thiophosphates. These may include zinc dialkyldithiophosphate, a phosphoric acid ester or salt thereof, a phosphite, or a phosphorus-containing ester, ether, or amide. The antiwear agent may be present at a concentration in the range up to about 10 weight percent, and in one embodiment in the range from about 0.1 to about 5 weight percent.

The rust inhibitor may comprise one or more metal sulphonates such as calcium sulphonate or magnesium sulphonate, amine salts of carboxylic acids such as octylamine octanoate, condensation products of dodecenyl succinic acid or anhydride and a fatty acid such as oleic acid with a polyamine, e.g. a polyalkylene polyamine such as triethylenetetramine, or half esters of alkenyl succinic acids in which the alkenyl group contains from about 8 to about 24 carbon atoms with alcohols such as polyglycols.

The rust inhibitors may present in the grease composition at a concentration in the range up to about 4 weight percent, and in one embodiment in the range from about 0.02 to about 2 weight percent, and in one embodiment in the range from about 0.05 to about 1 weight percent.

The viscosity modifier may comprise one or more polymeric materials including styrene-butadiene rubbers, ethylene-propylene copolymers, polyisobutenes, hydrogenated styrene-isoprene polymers, hydrogenated radical isoprene polymers, polymethacrylate acid esters, polyacrylate acid esters, polyalkyl styrenes, alkenyl aryl conjugated diene copolymers, polyolefins, polyalkylmethacrylates, esters of maleic anhydride-styrene copolymers and mixtures thereof.

Some polymers can also be described as dispersant viscosity modifiers (often referred to as DVM) because they also exhibit dispersant properties. Polymers of this type may include polyolefins, for example, ethylene-propylene copolymers that have been functionalized with the reaction product of maleic anhydride and an amine. Another type of polymer that may be used is a polymethacrylate functionalized with an amine (this type can also be made by incorporating a nitrogen containing co-monomer in a methacrylate polymerization).

The viscosity modifiers may be present in the grease composition at a concentration in the range up to about 30 weight percent, and in one embodiment in the range from about 0.5 to about 20 weight percent, and in one embodiment in the range from about 1 to about 5 weight percent.

The extreme pressure (EP) agents that may be used may include one or more sulphur or chlorosulphur EP agents, chlorinated hydrocarbon EP agents, phosphorus EP agents, or mixtures of two or more thereof. Examples of such EP agents may include chlorinated wax, organic sulphides and polysulphides, such as benzyldisulphide, bis-(chlorobenzyl) disulphide, dibutyl tetrasulphide, sulphurised sperm oil, sulphurised methyl ester of oleic acid, sulphurised alkylphenol, sulphurised dipentene, sulphurised terpene, and sulphurised Diels-Alder adducts; phosphosulphurised hydrocarbons, such as the reaction product of phosphorus sulphide with turpentine or methyl oleate, phosphorus esters such as the dihydrocarbon and trihydrocarbon phosphites, i.e., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid, zinc dicyclohexyl phosphorodithioate and the zinc salts of a phosphorodithioic acid combination.

The extreme pressure agents may be present in the grease composition at a concentration in the range up to about 10 weight percent, and in one embodiment in the range from about 0.25 to about 5 weight percent, and in one embodiment in the range from about 0.5 to about 2.5 weight percent.

The process for making grease may allow for less severe reaction conditions compared to known methods by reducing the time of grease formation and decreasing the duration in the temperature versus time relationship to reach the peak temperature necessary for fiber formation. The reaction between the LiOH and/or $LiOH.H_2O$ particulates and the carboxylic acid may be conducted at a temperature in the range from about 25 to about 220° C., and in one embodiment from about 80 to about 180° C. The formation of lithium complex grease may occur faster as evidenced by dropping point formation at temperatures as low as 104° C. in about 80% less time than with greases made with solid $LiOH.H_2O$ dissolved in water.

The process for making grease may allow for a reaction time that is reduced by about 15 to about 36% , and in one embodiment from about 48 to about 67% as compared to the prior art wherein a powdered form of the lithium hydroxide is used. Those skilled in the art will appreciate that the reduction in reaction time may be related to the degree of hydration of the lithium hydroxide. Higher degrees of hydration may slow the rate of reaction. Thus, the presence of hydrated lithium hydroxide may be avoided herein to provide for a reduction in reaction time.

The process for making grease may result in the formation of a reduced amount of foam as evidenced, for example, by elimination, in one embodiment, of foam at about 118° C., as compared to using processes that employ powdered forms of lithium hydroxide and water that foam for longer time periods due to excess water removal.

The process for making grease may comprise a batch, semi-continuous or a non-batch process.

The grease compositions disclosed herein may include lithium soap greases made with substantially only monocarboxylic acids, complex soap greases, lithium complex soap greases, calcium soap greases, low noise soap greases (sometimes characterized by the lack of residual metal hydroxide particles above about 2 microns in diameter), and short fiber high soap content greases.

The low noise greases may be used in rolling element bearing applications such as pumps or compressors. The complex soap greases may be smooth or show grain. The complex greases may contain a polycarboxylic acid, for example, a dicarboxylic acid.

EXAMPLE 1

Dispersions are prepared by milling slurries containing lithium hydroxide monohydrate, oil and a surfactant. The process hardware (the mill) comprises a jacketed horizontal vessel fitted with an agitator system and containing grinding media. The grinding media is in the form of beads. The slurry is pumped to and through the mill while in operation. Collisions of the beads and solids cause the attrition of both primary and secondary (agglomerate) crystals. The surfactant stabilizes the particles preventing re-agglomeration. The final product is a stabilized dispersion of fine lithium hydroxide monohydrate in oil. A batch vertical bead mill may be used instead of the continuous flow horizontal bead mill.

The vertical bead mill has a 500 ml round bottom glass vessel with a plastic lid, and a glass grinding media (2 mm or 4 mm diameter beads). Agitation is provided by either a low speed, high torque stainless steel (SS-10) or Heidolph mixer with a polyurethane paddle (rotational speed of 300-500 rpm). The mill has the capacity to process 300 ml of dispersion.

The horizontal bead mill may be supplied by WAB, Basle; ECM Dyno Mill MultiLab. The mill has a 0.6 liter chamber which contains three yttrium/zirconium oxide (YtZ) accelerators. The accelerators are operated at a tip speed of 8 meters per second (m/s), and a bead charge of 65% v/v (volume of bead/volume of chamber) using YtZ beads with diameters of 0.3 mm. The chamber is jacketed and water cooled. The mill is used to process 2 kg of slurry at a time in either a number of discreet single passes or in a continuous recirculation of the batch. A residence time of 5 to 10 minutes is used.

The tip speed is a function of the circumference of the mixing element (rotor) and the revolutions per minute (or second).

$$\text{Tip Speed} = \frac{2\pi r \times \text{rpm}}{60}$$

where r is the radius of the mixing element (in meters) and rpm/60 is the revolutions per second. Tip speed units are expressed as meters/second (m/s).

A single pass operation is a mode of operation where the material passes through the mill once. The pump rate through the mill is adjusted to give the desired residence (or milling) time. The following terms are used:

Vm—The working volume or the volume of dispersion in the mill chamber (liters)

Vt—Total volume of dispersion to be milled (liters)

F—Flow rate of dispersion through mill (liters/minute)

Tt—Total milling time (minutes)

The residence time is the duration of the material in the milling chamber and assumes plug flow through the vessel. Experiments with dyes injected into colorless materials in a glass chamber demonstrate that this is a valid assumption and there is little lateral mixing within the chamber.

$$\text{Residence Time } (Rs) = Vm/F \text{[units:time]}$$

$$\text{Milling time (one pass)} = Vt/F \text{[units:time]}$$

A batch operation is the mode of operation wherein the material being processed is pumped in a loop from a blending vessel through the mill and back to the blending vessel. The pump rate is kept high to maximize the number of statistical passes through the mill. If 10 liters of slurry are being milled in a recirculation mode and the slurry is pumped through the mill at the rate of 2 liters per minute, then after 5 minutes the volume equivalent of the slurry will have been pumped though the mill. One statistical pass occurs every 5 minutes under these conditions.

$$\text{Number of statistical passes through mill} = \frac{Tt.\ F}{Vt} \text{[unit: number]}$$

$$\text{Total Residence time } (Rr) = \frac{Vm.\ Tt}{Vt} \text{[unit: time]}$$

The total residence time in a recirculating batch process can also be calculated as follows: Total Residence time (Rr)= Number of Statistical Passes×Residence time, Rs (per pass).

Dispersions are characterised by particle size measurement carried out by Coulter LS230 and microscopy and by storage stability. Coulter LS230 is a commerical particle size analyzer (supplied by Beckman Coulter) designed to measure particles from 0.04 to 2000 microns in diameter using a laser diffraction technique based on the Fraunhofer and Mie theories of light scattering by colloidal particles.

A number of surfactants are evaluated as possible dispersants for lithium hydroxide monohydrate ($LiOH.H_2O$). These formulations are prepared using the vertical bead mill. Fourteen samples are prepared using seven hours processing in a laboratory assembled vertical bead mill, and their chemical compositions and manufacturing details are presented in Table 1. The surfactants identified in Table 1 are labelled as Surfactants A-E. These surfactants are described below. $LiOH.H_2O$ from a different batch is used for Sample 1 as compared to Samples 3-14.

TABLE 1

| Sample | Glass Beads Dia mm | Composition (% w/w) Solvent Material | Solvent (%) | Solid Material | Solid (%) | Surfactant Name | Surfactant (%) |
|---|---|---|---|---|---|---|---|
| 1 | 0.2 | 100SN | 60.1 | $LiOH•H_2O$ | 22.4 | A | 17.5 |
| 2 | 0.2 | 100SN | 51.34 | Lithium Carbonate | 33.7 | A | 14.95 |
| 3 | 0.4 | 600SN oil | 45.0 | $LiOH•H_2O$ | 50.0 | B | 5.0 |
| 4 | 0.4 | Poly alpha olefin oil | 32.36 | $LiOH•H_2O$ | 60.0 | C | 7.6 |
| 5 | 0.4 | 100SN | 60.1 | $LiOH•H_2O$ | 22.4 | A | 17.5 |
| 6 | 0.4 followed by 0.2 | 100SN | 60.2 | $LiOH•H_2O$ | 22.5 | A | 17.5 |
| 7 | 0.4 | 330SN oil | 60.1 | $LiOH•H_2O$ | 22.4 | D | 17.5 |
| 8 | 0.4 followed by 0.2 | 330SN oil | 60.2 | $LiOH•H_2O$ | 22.5 | D | 17.5 |
| 9 | 0.4 | 100SN | 70.0 | $LiOH•H_2O$ | 25.0 | A | 5.0 |
| 10 | 0.2 | 100SN | 60.1 | $LiOH•H_2O$ | 22.4 | A | 17.5 |
| 11 | No | 100SN | 60.1 | $LiOH•H_2O$ | 22.4 | A | 17.5 |
| 12 | 0.4 followed by 0.2 | 100SN | 65.0 | $LiOH•H_2O$ | 25.0 | A | 10.0 |
| 13 | 0.4 followed by 0.2 | 100SN | 70.0 | $LiOH•H_2O$ | 25.0 | D | 5.0 |
| 14 | 0.4 followed by 0.2 | 100SN | 51.0 | $LiOH•H_2O$ | 26.0 | E | 14.0 |

The surfactants identified in Table 1 are as follows:

Surfactant A: polyisobutenyl dihydro-2,5-furandione ester with pentaerythritol mixed with diluent oil (44% by weight dil oil)

Surfactant B: polyolefin aminoester mixed with diluent oil (26% by weight dil oil)

Surfactant C: alkylbenzene sulfonic acid mixed with diluent oil (23% by weight dil oil)

Surfactant D: polyisobutenyl (Mn = 940) succinic acid mixed with diluent oil (25% by weight dil oil)

Surfactant E: Propylamine ethoxylate supplied by Huntsman under the name Empilan AMT7.

The solvents in Table 1 are characterized as indicated in Table 2.

TABLE 2

| | Dil Oil or 100N Oil* | 325SN | 330SN | 600SN | Polyalpha-olefin |
|---|---|---|---|---|---|
| Viscosity @40° C. (cSt) | 20.059 | 61.695 | 66.65 | 111.306 | 30.157 |
| Viscosity @100° C. (cSt) | 4.051 | 8.144 | 8.455 | 11.941 | 5.731 |
| Viscosity Index | 99 | 99 | 96 | 96 | 134 |
| Specific Gravity (ASTM D4052) | 0.8584 | 0.8824 | 0.885 | 0.8813 | 0.8273 |

*100N oil may be referred to in the text as 100SN oil.

The samples reported in Table 1 are characterized by Coulter LS230 and storage stability and this is presented in Table 3.

TABLE 3

| | Storage stability, RT | | | | | | | | Coulter LS230, Particle Size, μm | | | | |
|---|---|---|---|---|---|---|---|---|---|---|---|---|---|
| | DAY | | 1 WEEK | | 2 WEEKS | | 4 WEEKS | | % | % | % | | |
| Sample | O | L | O | L | O | L | O | L | <5 μm | <1 μm | <0.5 μm | Mean | Largest |
| 1 | 0 | 0 | 0 | 0 | 0 | 0 | 0 | 0 | 100 | 100 | 99.2 | 0.179 | 0.868 |
| 2 | 0 | 0 | 0 | 0 | 0 | 0 | 0 | 0 | 96.8 | 22.4 | 5.27 | 1.985 | 11.83 |
| 3 | 0 | 0 | 0 | 0 | 0 | 0 | 1 | 0 | 78.9 | 7.78 | 0.87 | 3.794 | 92.09 |
| 4 | 1 | 0 | 1 | 0 | 3 | 0 | 10 | 0 | 41.6 | 0.18 | 0 | 6.312 | 22.73 |
| 5 | — | — | — | — | — | — | — | — | 48.2 | 1.18 | 0.08 | 6.163 | 39.78 |
| 6 | 0 | 0 | 1 | 3.5 | 5 | 7 | 11 | 7 | 53.8 | 6.17 | 1.24 | 6.555 | 69.61 |
| 7 | — | — | — | — | — | — | — | — | 33.2 | 2.15 | 0.30 | 9.713 | 99.09 |
| 8 | 0 | 0 | 0 | 0 | 0 | 0 | 3 | 0 | 63.3 | 10.7 | 3.19 | 5.514 | 76.42 |
| 9 | 0 | 0 | 4 | 2 | — | — | 6 | 6 | 80 | 16.4 | 4.72 | 3.519 | 57.77 |
| 10 | 0 | 0 | 0 | 0 | — | — | — | — | 82 | 62.9 | 42.4 | 4.352 | 63.41 |
| 11 | 74 | 26 | 76 | 24 | — | — | 83 | 17 | 0 | 0 | 0 | 442.7 | 1143 |
| 12 | 0 | 0 | 0 | 0 | 0 | 0 | 0 | 3 | 100 | 76.5 | 50.8 | 0.688 | 4.2 |
| 13 | 0 | 0 | 0 | 0 | 0 | 0 | 2 | 2 | 100 | 89.2 | 69.0 | 0.471 | 3.2 |
| 14 | 0 | 0 | 3 | 0 | 3 | 0 | 7 | 0 | 100 | 75.8 | 48.9 | 0.686 | 4.2 |

In Table 3, "O" refers to the formation of a clear oil layer at the top of the sample tube (expressed as % height of the sample tube). "L" refers to the formation of a bottom layer of sediment in the sample tube (expressed as % of height of the sample tube).

The dispersion for Sample 6 is heated to 95° C. for 3 hours in order to drive off the water of crystallisation. Particle size analysis (Coulter LS230) indicates a mean size of 6.55 microns with 1.2% by volume being below 0.5 microns, and 6.2% by volume being below 1 micron before heating. After heating a reduction in particle size is measured, with a mean of 0.51 microns, and 90% by volume being below 0.5 micron.

A series of experiments are conducted in the horizontal bead mill using wet milling in two stages—a coarse grind with larger beads followed by a fine grind with smaller beads. Four kilograms of the slurry detailed in Table 4 are processed using the horizontal bead mill to form dispersions.

TABLE 4

| Components | % w/w |
|---|---|
| $LiOH \cdot H_2O$ | 50 |
| 100N oil | 40 |
| Surfactant A | 10 |
| Total | 100 |

The slurry is first processed using 65% v/v of 2 mm diameter glass beads, YtZ accelerators at 8 m/s tip speed, and a total residence time of 9.59 minutes which is achieved in three discreet passes. The resulting dispersion is further processed using the horizontal bead mill with 65% v/v of 0.3 mm diameter YtZ beads, YtZ accelerators at 8 m/s tip speed, and a residence time of 10.29 minutes.

The data for these samples are presented in Table 5

TABLE 5

| Sample | Passes | Beads (mm) | Residence Time | Microscope Rating | Coulter LS230 (microns) <0.5 | <1.0 | Mean | Lrg |
|---|---|---|---|---|---|---|---|---|
| 16 | 1 | 2 | 2.96 | H | 0.71 | 3.26 | 13.7 | 176.9 |
| 17 | 2 | 2 | 5.76 | H | 7.25 | 16.6 | 4.39 | 43.7 |
| 18 | 3 | 2 | 9.59 | D | 11.7 | 23.6 | 3.49 | 39.8 |
| 19 | 1 | 0.3 | 2.91 | A | 49.4 | 73.7 | 0.836 | 17.2 |
| 20 | 2 | 0.3 | 7.27 | A | 74.4 | 93.6 | 0.401 | 3.5 |
| 21 | 3 | 0.3 | 10.29 | A | 83.3 | 99.3 | 0.307 | 1.5 |

The final particle size suggests that this product may be stable for many months.

In Table 5 and elsewhere in this specification, microscopic ratings of A, B, C, D, E, F, G or H are indicated. These ratings are based on subjective evaluations classifying the dispersions as fine or coarse dispersions. A rating of "A" for a dispersion is indicated for a very fine dispersion. A rating of "H" is provided for a very coarse dispersion. The ratings progress gradually from very fine (A) to very coarse (H) with graduated ratings of B, C, D, E, F or G in between.

The effect of heat on Samples 15, 18 and 21 is shown in Table 6. This indicates that the effect of particle size reduction due to dehydration is greatest when the particles are coarse (order of size reduction after heating is: Sample 15>18>21).

TABLE 6

| Sample | % solid | Surfactant | % Surf | Particle Size (microns) before heating % <0.5 | % <1.0 | Mean | Largest | Particle size (microns) after 95° C. 5 hours % <0.5 | % <1.0 | Mean | Largest |
|---|---|---|---|---|---|---|---|---|---|---|---|
| 15 | 50 | A | 10 | 19.9 | 30.8 | 54.4 | 282.1 | 27 | 48.9 | 18.8 | 133.7 |
| 18 | 50 | A | 10 | 11.7 | 23.6 | 3.494 | 39.9 | 20.2 | 35.6 | 2.766 | 39.8 |
| 21 | 50 | A | 10 | 83.3 | 99.3 | 0.307 | 1.5 | 81.2 | 99 | 0.321 | 1.5 |

Heating the dispersion of lithium hydroxide monohydrate removes water of crystallization. Lithium hydroxide monohydrate has a tetragonal crystal structure while anhydrous lithium hydroxide has a more compact tetrahedral structure.

The particle size of Sample 21 does not change when the sample is heated. However when this sample is prepared a strong exotherm occurs during production.

EXAMPLE 2

Samples of $LiOH.H_2O$ powders are obtained from Chemetall, FMC and SQM. The $LiOH.H_2O$ powders are mixed in 100N oil and characterized using an optical light microscope. The lithium hydroxide monohydrate crystals in both of these powders are tetragonal in shape. The FMC product crystals are typically 200-600 microns in length and the SQM crystals are typically larger than 800 microns. The Chemtall crystals are in between the foregoing.

Two experiments are carried out. In both experiments four kilograms of the following slurry are prepared:

TABLE 7

| Component | % w/w |
|---|---|
| $LiOH \cdot H_2O$ (FMC) | 50 |
| 100N | 40 |
| Surfactant D | 10 |

Experiment 2:

The coolant temperature is set at 15° C. During the $4^{th}$ pass (first pass with the 0.5 mm beads) the temperature is observed to creep up from 70° C. to 80° C. before falling back again. Analysis is carried out as in Experiment 1. Data are presented in Table 9. Particle size analysis (Coulter LS230 and Malvern Zetasizer) of the dispersion samples are shown in Table 8. The viscosity and density measurements are shown in Table 9.

TABLE 8

| Pass No. | Cumulative Residence Time (min) | Beads size (mm) | Coulter LS230 particle size analysis (μm) % <5 | % <1 | % <0.5 | Mean | Largest particle | Malvern Avge* (nm) |
|---|---|---|---|---|---|---|---|---|
| Experiment 1 (cooler at 4° C.) | | | | | | | | |
| 1 | 1.74 | 2 | 20.1 | 0.82 | 0.054 | 20.18 | 282.1 | |
| 2 | 4.49 | 2 | 49.1 | 7.81 | 2.6 | 7.797 | 76.42 | |
| 3 | 9.9 | 2 | 80.8 | 28.6 | 14.9 | 3.22 | 43.67 | |
| 4 | 12.18 | 0.5 | 95.6 | 51.1 | 29.4 | 1.447 | 12.99 | |
| 5 | 15.59 | 0.5 | 99.5 | 77.9 | 54.2 | 0.701 | 8.147 | |
| 6 | 20.65 | 0.5 | 100 | 88.2 | 66.2 | 0.488 | 3.519 | |
| 7 | 23.07 | 0.3 | 100 | 93.6 | 74.4 | 0.399 | 3.519 | |
| 8 | 27.56 | 0.3 | 100 | 99 | 81 | 0.322 | 1.52 | |
| 9 | 30.07 | 0.3 | 100 | 99.3 | 83.1 | 0.308 | 1.52 | 212 |
| | 60 | 0.3 | 100 | 100 | 100 | 0.114 | 0.412 | 173 |
| Experiment 2 (cooler at 15° C.) | | | | | | | | |
| 1 | 6.82 | 2 | 42.2 | 13.5 | 7.25 | 14.34 | 133.7 | |
| 2 | 10.74 | 2 | 83 | 37.9 | 21.9 | 3.024 | 47.94 | |
| 3 | 12.95 | 2 | 82.3 | 33.3 | 18.3 | 3.025 | 43.67 | |
| 4 | 16.43 | 0.5 | 100 | 88.3 | 67.2 | 0.476 | 3.519 | |
| 5 | 19.28 | 0.5 | 100 | 85.3 | 62.6 | 0.544 | 3.863 | |
| 6 | 23.52 | 0.5 | 100 | 93.8 | 75.4 | 0.394 | 3.519 | |
| 7 | 25.64 | 0.3 | 100 | 96.2 | 77.8 | 0.364 | 3.205 | |
| 8 | 29.37 | 0.3 | 100 | 99.4 | 83.9 | 0.303 | 1.52 | |
| 9 | 33.19 | 0.3 | 100 | 99.5 | 85.3 | 0.294 | 1.52 | 197 |

*Average of three measurements.

The slurry is passed through the horizontal bead mill for a total of nine passes in succession. In all cases the mill is operated at a tip speed of 8 m/s and filled with beads (65% v/v). The pump rate for each pass through the mill is such that the sample residence time is around 3 minutes. In both experiments the mill is charged sequentially with beads as follows:

(1) 2 mm diameter glass beads for the first 3 passes;

(2) 0.5 mm diameter yttrium/zirconium beads for the $4^{th}$ to $6^{th}$ passes;

(3) 0.3 mm diameter yttrium/zirconium beads for the $7^{th}$ and subsequent passes.

Experiment 1:

The coolant temperature is set at 4° C. for the first 9 passes. The temperature of the dispersion (in the mill) is constant throughout at 70° C. After the dispersion is passed through the mill for the nine passes it is milled for a further 30 minutes residence time using the 0.3 mm beads. The coolant temperature is allowed to rise to 10° C. during this stage. No significant product temperature change is observed. The results are shown in Table 8. The $LiOH.H_2O$ to LiOH ratio is ascertained for these samples by thermogravimatic analysis (TGA). Particle size analysis is carried out using the Coulter LS230 and a Malvern Zetasizer Nano ZS. The Malvern Zetasizer Nano ZS is a light scattering instrument supplied by Malvern capable of measuring in the range of 0.6 nanometers (nm) to 6 microns. The viscosity and density are reported in Table 9.

The dynamic viscosity and density measurements of the final samples for Experiments 1 and 2 are shown below in Table 9

TABLE 9

| Sample | Viscosity @ 250 $s^{-1}$ (cP) | Density (g/ml) |
|---|---|---|
| Expt 1, pass 9 | 493 | 1.0839 |
| Expt 2, pass 9 | 387 | 1.0839 |

EXAMPLE 3

Thermogravimetric analysis (TGA) of the following samples are conducted:

(1) Anhydrous LiOH powder.

(2) $LiOH.H_2O$ powder.

(3) Anhydrous LiOH slurry (50% by weight LiOH, 10% by weight Surfactant D and 40% by weight 100N oil).

(4) $LiOH.H_2O$ slurry (50% by weight $LiOH.H_2O$, 10% by weight Surfactant D, and 40% by weight 100N oil).

(5) Dispersions of $LiOH.H_2O$ prepared with 2 mm beads with 1, 2 and 3 passes respectively.

(6) Dispersion of $LiOH.H_2O$ prepared with 1 pass through mill using 2 mm, 0.5 mm and 0.3 mm beads respectively.

In all of the TGA traces about 20% by weight of material is removed below 130° C. This corresponds to 40% by weight mass of the solid $LiOH.H_2O$. The theoretical water content of $LiOH.H_2O$ is 42% by weight and hence this is in line with theory. The material removed above 150° C. is due to the base oil and surfactant vaporization.

The water of crystallization present in the powdered $LiOH.H_2O$ can be removed below 100° C. by direct heating. However, when the powder is made into a slurry with oil and surfactant the water becomes harder to remove as seen by a shift in the TGA peak from below 100° C. to about 110° C. The water of crystallisation readily leaves the solid crystal, however when the crystals are suspended in oil the water condenses as free water and further energy is required to drive the water from the oil phase.

that after dehydration the rhomboid crystals have changed to amorphous solids, interspersed with long crystalline needles. A reduction in sample volume is noted.

The dehydrated slurry is milled in several sequential passes with a residence time of about 3 minutes per pass. The sample is milled in 3 passes with 2 mm beads and then 3 passes with 0.5 mm beads. Final and intermediate samples are analyzed. The results are shown in Table 11.

TABLE 11

| Sample | Pass No | Bead size (mm) | Cumulative residence time (mins) | Coulter LS230 particle size analysis (microns) % <0.5 | % <1 | Mean | Lrg | Microscope Rating |
|---|---|---|---|---|---|---|---|---|
| 1 | Slurry | N/A | 0 | 0 | 0 | ~400 | 600 | D+ |
| 2 | Desiccated slurry, no milling | N/A | 0 | 0 | 0 | ~200 | 400 | D |
| 3 | Desiccated slurry, then milled 1 pass | 2 | 3.27 | 0 | 0 | 50.37 | 177 | D |
| 4 | Desiccated slurry, then milled 2 passes | 2 | 5.17 | 0 | 0 | 49.84 | 161 | D |
| 5 | Desiccated slurry, then milled 3 passes | 2 | 8.02 | 0 | 0 | 48.55 | 161 | D |
| 6 | Desiccated slurry, then milled 4 passes | 0.5 | 10.20 | 0 | 0 | 46.37 | 122 | D |
| 7 | Desiccated slurry, then milled 5 passes | 0.5 | 13.47 | 0 | 0 | 46.29 | 121 | D |
| 8 | Desiccated slurry, then milled 6 passes | 0.5 | 17.71 | 0 | 0 | 46.06 | 122 | D |

TGA analysis of the samples prepared in Experiments 1 and 2 (Example 2) indicate that the temperature of the coolant has virtually no effect on the final dispersion—the TGA traces are similar. The particle size of the final dispersions are similar for both Experiments 1 and 2 (see, Table 8).

The foregoing indicates:

(1) Dehydration of solid LiOH monohydrate is a relatively easy step and occurs below the boiling point of water.

(2) Dehydration of solid LiOH monohydrate in suspension in oil requires more energy than the dehydration of the solid alone. The water is entrapped in the oil phase, where it may then participate in other interactions with the materials present in the oil (possibly forming a higher boiling temperature azeotropic mixture) making it more difficult to remove.

(3) Milling of the LiOH monohydrate to a submicron dispersion (for example, to a sub 0.5 micron dispersion) is relatively easy to achieve.

EXAMPLE 4

Three kilograms of the slurry shown in Table 10 are prepared by mixing the components in a saw-tooth mixer.

TABLE 10

| Components | % w/w |
|---|---|
| $LiOH{\bullet}H_2O$ (FMC) | 50 |
| 100N | 40 |
| Surfactant D | 10 |

Dehydration of the slurry shown in Table 10 is carried out by heating on a hot plate at 125° C. for 6 hours. Complete dehydration of the 3 kg of slurry is confirmed by TGA prior to milling. Samples are characterized before and after dehydration by microscope and Coulter LS230. Microscopy indicates Sample 8 has a viscosity of 191 cP at 250 $s^{-1}$ and a density of 1.0266 at 15° C.

Both microscopy and Coulter indicate that the LiOH (anhydrous) suspension is more resistant to size reduction during the milling process when compared to the $LiOH.H_2O$. Microscopy and Coulter measurements indicate that the crystal size of about 40-60 microns may be the limit achievable. Some long crystals are observed microscopically despite the prolonged milling.

This result suggests that anhydrous LiOH is difficult to mill to a submicron dispersion. This is in contrast with the ease of milling $LiOH.H_2O$ and suggests a viable route for making good submicron dispersions of LiOH (with or without the water of crystallization present). On heating $LiOH.H_2O$ the water of crystallization is readily removed. Further heating results in melting of the solid at about 470° C. This is a relatively low melting point. Milling is known to generate local temperatures in excess of 1000° C. at the point of impact. However, when the solid is hydrated, the local heat may be dissipated by the dehydration process. As milling progresses the process of crystalline fracture, dissipation of the high local thermal energy by evaporation allows the solid to be reduced in size. If the water of crystallization is removed then the solid may heat up to the melting point and crystal growth may become more significant. The solid may become softer and difficult to fracture.

EXAMPLE 5

This example shows a process for making submicron dispersions wherein $LiOH.H_2O$ is milled and then dehydrated. A slurry with the formulation shown in Table 12 is prepared.

TABLE 12

| Components | % w/w |
|---|---|
| $LiOH \cdot H_2O$ | 50 |
| 100N oil | 40 |
| Surfactant D | 10 |

The slurry is passed through the horizontal bead mill several times in single passes. In all cases the mill is operated at a tip speed of 8 m/s and filled with beads (65% v/v). The pump rate for each pass through the mill is such that the sample residence time is about 3 minutes per pass. Coolant temperature is set at 4° C. In this example the mill is charged sequentially with beads as follows:

2 mm diameter glass beads for the first 3 passes;

0.5 mm diameter yttrium/zirconium beads for the $4^{th}$ to $6^{th}$ passes; and 0.3 mm diameter yttrium/zirconium beads for the $7^{th}$ and subsequent passes.

Samples are taken after each pass and these are sized by microscope and Coulter LS230. The samples taken after 1, 3, 4 and 6 passes are also dehydrated. Dehydrated samples are prepared using a hot plate and these are characterized by Coulter LS230 and microscopy.

The data may be used to determine the relative ease of dehydrating a dispersion versus a slurry. The effect of particle size reduction (if any) upon dehydration can also be ascertained and a milling residence time for a particular particle size can be determined. A further experiment is carried out to determine dehydration rate. The results are shown in Table 13. In Table 13 the $LiOH.H_2O$ dispersion is characterized before and after dehydration.

TABLE 13

| Sample | Pass No. | Bead size (mm) | Cumulative residence time (mins) | Before/ after dehydration | Coulter LS230 particle size analsis (microns) % <0.5 | % <1 | Mean | Lrg | Microscope Rating |
|---|---|---|---|---|---|---|---|---|---|
| 1 | 1 | 2 | 3.45 | Before | 0.18 | 1.34 | 25.06 | 340 | D+ |
| | 1 | 2 | | After* | 24.1 | 40.0 | 3.7 | 122 | D |
| 2 | 3 | 2 | 9.21 | Before | 16 | 29.5 | 3.80 | 161 | D |
| | 3 | 2 | | After | 40.3 | 55.5 | 1.936 | 48 | C |
| 3 | 4 | 0.5 | 12.12 | Before | 39.7 | 62.7 | 1.118 | 21 | C |
| | 4 | 0.5 | | After | 91.9 | 96.7 | 0.298 | 13 | B |
| 4 | 6 | 0.5 | 19.39 | Before | 68.7 | 90 | 0.464 | 4 | B |
| | 6 | 0.5 | | After | 100 | 100 | 0.143 | 0.5 | B |

*TGA indicates only partial dehydration of this sample. 9% w/w water remaining.

A slurry and two dispersions are dehydrated and the rate of dehydration is compared. The test results are shown in Table 14.

TABLE 14

| Sample | Largest particle before dehydration - Microscope (microns) | Sample | Largest particle after dehydration - Microscope (microns) | Heating Time (mins) | Remaining water (TGA determination) | Density |
|---|---|---|---|---|---|---|
| Slurry (Std dehydration) | D+ ~400 | 1 | D+ 400 | 10 | Yes | |
| | | 2 | D+ 400 | 20 | Yes | |
| | | 3 | D+ 400 | 30 | Yes | |
| | | 4 | D+ 400 | 40 | No | |
| | | 5 | D+ 400 | 50 | No | N/A |
| Dispersion | C/D 10 | 6 | D 20 | 20 | Yes | |
| | | 7 | C/D 14 | 35 | No | |
| | | 8 | C/D 13 | 50 | No | |
| | | 9 | C/D 16 | 65 | No | |
| | | 10 | C/D 13 | 75 | No | |
| | | 11 | C/D 16 | 90 | No | 1.0792 |
| Dispersion | B 4 | 12 | B 4 | 22 | Yes | |
| | | 13 | B 6 | 40 | Yes | |
| | | 14 | B 6 | 50 | No | |
| | | 15 | B 6 | 70 | No | |
| | | 16 | B 5 | 85 | No | |
| | | 17 | B 7 | 95 | No | 1.0790 |

The viscosity at 250 $s^{-1}$ for Sample 11 is 540 cP and for Sample 17 the viscosity is 302 cP. The results indicate that similar dehydration conditions are required to dehydrate a dispersion or slurry. Since there is no reduction in particle size during dehydration, it is advantageous to mill down to the desired size before dehydration.

EXAMPLE 5A

The effect of particle size on the dehydration efficiency is demonstrated to be negligible on a commercial pilot scale using a wiped film evaporator (supplied by Kuhni AG). The evaporator column has a surface area of 0.14 $m^2$ and is an 80 mm diameter, 55 cm long column fitted with a stainless rotating wiper. A film of feed product is formed (1 mm thickness) down the length of the vertical column.

The starting material or feed product is a 50% weight of LiOH.H2O dispersion (composition is shown in Table 21, Experiment C, below) prepared on a 100 kg scale using an ECM Pro Dyno Mill (supplied by WAB of Switzerland) charged with 1.2 mm beads and operated in a continuous recirculation mode. The Feed Product is pumped from the stirred reactor vessel to the top of the evaporator. The temperature of the Feed Product at the top of the evaporator is adjusted to 90° C. The rate and extent of evaporation is primarily a function of:

1. The feed product throughput;
2. The stripping vacuum pressure applied;
3. The heating input (supplied and varied by the heating oil jacket around the column).

The dehydrated product is collected at the bottom. The distillate is condensed through a primary and secondary condensation unit.

This experiment explores the effect of oil temperature (which heats the fluid on the column), the vacuum pressure, and the flow rate of material through the unit. The first experiments are carried out using sample A (fine dispersion approximately 5 microns mean) and this is followed by the coarse dispersion (Sample C, approximately 200 microns mean) and then the middle coarse dispersion (Sample B, approximately 10 micron mean). The coarse sample (C) tends to form a hard sediment on standing for a few hours and is agitated throughout the experiment. All three products, which contain 21.4% weight water (chiefly as water of crystallization in LiOH.H2O), behave similarly giving complete dehydration (down to 0.1% weight water content as determined by Dean and Stark method) at a flow rate of 15 kg/hr and a pressure of 80 mbar and an oil temperature of 130° C. The residual water content is 0.5% weight in the final product when the flow rate is increased to 20 kg/hr.

EXAMPLE 6

A slurry with the formulation shown in Table 15 is prepared.

TABLE 15

| Component | % w/w |
|---|---|
| $LiOH{\bullet}H_2O$ (FMC) | 60 |
| 100N | 34 |
| Surfactant F | 6 |

Surfactant F is a polyisobutenyl (Mn=940) succinic anhydride.

The slurry is passed through the horizontal bead mill for a total of nine single passes in succession. In all cases the mill is operated at a tip speed of 8 m/s and filled with beads (65% v/v). The pump rate for each pass through the mill is such that the sample residence time is about 3 minutes. In each test run the mill is charged sequentially with beads as follows:

1. 2 mm diameter glass beads for the first 3 passes;
2. 0.5 mm diameter yttrium/zirconium beads for the $4^{th}$ to $6^{th}$ passes;
3. 0.3 mm diameter yttrium/zirconium beads for the $7^{th}$ and subsequent passes.

The processing conditions are shown in Table 16.

TABLE 16

| Sample | Bead Size (mm) | Pass | Cumulative Residence time (mins) |
|---|---|---|---|
| 1 | 2 | 1 | 7.85 |
| 2 | 2 | 2 | 11.12 |
| 3 | 2 | 3 | 12.62 |
| 4 | 0.5 | 4 | 16.11 |
| 5 | 0.5 | 5 | 19.58 |
| 6 | 0.5 | 6 | 22.33 |
| 7 | 0.3 | 7 | 28.87 |
| 8 | 0.3 | 8 | 34.48 |
| 9 | 0.3 | 9 | 39.46 |

The results are shown in Table 17.

TABLE 17

| | Before dehydration | | | | | After dehydration |
|---|---|---|---|---|---|---|
| | Coulter LS230 | | | | Microscope | Microscope |
| Sample | % <0.5 | % <1 | Mean | Lrg | Rating | Rating |
| 1 | 11.6 | 23.8 | 3.4 | 36 | | |
| 2 | 16.9 | 32.1 | 2.6 | 36 | | |
| 3 | 20. | 37.5 | 2.13 | 30 | D | C/D |
| 4 | 50.6 | 74.7 | 0.76 | 8.1 | | |
| 5 | 65.3 | 87.9 | 0.50 | 3.9 | | |
| 6 | 70.6 | 91.4 | 0.44 | 3.5 | A/B | B |
| 7 | 78.3 | 96.9 | 0.36 | 3.2 | | |
| 8 | 80.1 | 97.6 | 0.34 | 3.2 | | |
| 9 | 100 | 100 | 0.17 | 0.7 | A | B |

EXAMPLE 7

A dehydrated dispersion is prepared using the horizontal bead mill. The mill is operated at a tip speed of 8 m/s and filled with beads (65% v/v). The dispersion formulation and characterization are provided in Table 18 and the dehydrated dispersion data are presented in Table 19.

TABLE 18

| | % w/w |
|---|---|
| Component | |
| LiOH (FMC) | 60 |
| 100N | 35 |
| Surfactant F | 5 |
| Characterization | |
| Microscope | B |

TABLE 19

| Component | % w/w |
|---|---|
| LiOH (FMC) | 46.09 |
| 100N | 48.52 |
| Surfactant F | 5.39 |
| Characterization | |
| Microscope | B |

An additional 30% by weight of $LiOH.H_2O$ (FMC) is added to the dispersion shown in Table 19 and the resulting mixture is passed through the horizontal bead mill another six passes in succession. In all cases the mill is operated at a tip speed of 8 m/s and filled with beads (65% v/v). The pump rate for each pass through the mill is such that the sample residence time is about 3 minutes.

In each experiment the mill is charged sequentially with beads as follows:

1. 2 mm diameter glass beads for the first 3 passes; and
2. 0.5 mm diameter yttrium/zirconium beads for the $4^{th}$ to $6^{th}$ passes.

This sample has a microscope rating of B 8. The sample is dehydrated and the final formulation and characterization are shown in Table 20.

TABLE 20

| Component | % w/w |
|---|---|
| LiOH (FMC) | 54 |
| 100N | 41.4 |
| Surfactant F | 4.6 |
| Characterization | |
| Microscope | A/B |

The lithium hydroxide powders are coarse granular materials (several mm in dimension). For this reason it is advantageous to do a coarse wet-grind using the 2 mm diameter glass beads. These beads may grind the solid to a mean particle size of about 3 microns. If the solid/bead size ratio is too large bead milling may only reduce the size of the finer crystals and have little effect on the coarse material. A short milling time may be sufficient to break the large particles (the first pass samples may be sufficiently small to be milled with the 0.5 and/or 0.3 mm beads).

Surfactant F performs well as a stabilizer. It produces dispersions with good milling efficiency, good stability and low viscosity even at low treat rates.

Significant dehydration is not observed during milling. When dehydrating conditions are applied, the slurry and dispersions may be fully dehydrated using identical conditions. Since dehydrated dispersions are less easily milled, it is advantageous to mill and then dehydrate. If the mill is not cooled efficiently during milling the heat caused in the milling process may be used to enhance desiccation.

The foregoing indicates that a two stage milling process may be used wherein a maximum of about 46% w/w LiOH may be achieved after stage 1 and at least about 54% w/w, and in one embodiment at least about 60% w/w, may be achieved after stage 2.

TGA may be used satisfactorily to determine the remaining water content of lithium hydroxide monohydrate dispersions after desiccation.

The foregoing indicates the following:

1. It is relatively easy to drive off the water of crystallization in $LiOH.H_2O$.
2. $LiOH.H_2O$ is an easy material to bead mill, yielding a fine sub 0.5 micron dispersion with ease. By contrast the anhydrous LiOH is difficult to mill to below submicron particle size.
3. The capability of $LiOH.H_2O$ to undergo endothermic dehydration provides a mechanism for ruptured crystals to dissipate the energy they receive upon impact with the beads. This energy may be converted to thermal energy in LiOH (anhydrous) and to melting of the surface, opening up the opportunity for crystal growth mechanisms to come into play.
4. A process that may be useful for obtaining a sub 0.5 micron dispersion with high solids content (54% mass LiOH) and low surfactant (4.6% mass) involves a repeat sequential milling and dehydration of the dispersion with further addition of $LiOH.H_2O$ powder in between.

EXAMPLE 8

Three formulations are utilized in this study and these are shown in Table 22. Two sources of $LiOH.H_2O$ are used; FMC and SQM. The main difference between the two sources of lithium is the crystalline size of the starting powder. The SQM material is more coarse than the FMC material.

TABLE 21

| | Experiment: | | |
|---|---|---|---|
| | A | B, D | C |
| FMC $LiOH•H_2O$ | 50 | 50 | — |
| SQM $LiOH•H_2O$ | — | — | 50 |
| 100N oil | 45 | — | — |
| 330SN oil | — | 45 | 45 |
| Surfactant F | 5 | 5 | 5 |

10 Kg of each slurry are prepared in accordance with the formulations in Table 22 using a saw-tooth mixer. These slurries are milled using the horizontal bead mill which is operated in single discrete passes. The mill is operated using a tip speed of 8 m/s, three YtZ accelerators, a bead charge of 65% v/v. The milling sequence for each experiment is shown in Table 22.

TABLE 22

| | No of Passes | Total Res Time (min) |
|---|---|---|
| Experiment A [FMC; 100N] | | |
| 2 mm beads | 3 | 10.51 |
| 0.5 mm beads | 3 | 6.25 |
| Experiment B [FMC; 330SN] | | |
| 2 mm beads | 3 | 10.52 |
| 0.5 mm beads | 3 | 13.06 |
| Experiment C [SQM; 330SN] | | |
| 2 mm beads | 1 | 5.61 |
| 0.5 mm beads | 3 | 10.63 |
| Experiment D [FMC; 330SN] | | |
| 2 mm beads | 1 | 2.96 |
| 0.5 mm beads | 3 | 11.23 |

The following procedural steps are noted:

1. A homogenous slurry is prepared. Continuous agitation is used for the slurry.
2. Milling with 2 mm diameter YtZ beads: In experiments A and B three passes with a total residence time of 10.5 minutes are used, while in Experiment C and D single passes with residence times of 5.6 and 3 minutes, respectively, are used.
3. Milling with 0.5 mm diameter YtZ beads: In all cases three sequential passes are used.

Samples are taken after the first and last passes through the mill. At the end of milling all samples that are taken are divided into two and one set dehydrated on a laboratory hotplate at 130° C. for 7 hours. Complete dehydration was confirmed by TGA. All samples are characterized by optical microscopy, Coulter LS230 and storage stability. In addition to this each sample is tested for pour point, flash point, density, nitrogen content and IR spectroscopy. The results are shown in Table 23.

TABLE 23

| Sample | Pass No. | Bead diameter | Cumulative time per bead size/ min | Coulter Ls230 PSA % <0.5 μm | % <1.0 μm | mean | Largest | Microscopy (×400) Rating | 4 wk Storage Stability RT S | RT B | 60° C. S | 60° C. B |
|---|---|---|---|---|---|---|---|---|---|---|---|---|
| A1 | 1 | 2 mm | 2.34 | 10.1 | 16.7 | 8.05 | 83.9 | C/D | 0 | 0 | 2 | 7 |
| A2 | 2 | 2 mm | 5.75 | — | — | — | — | — | | | | |
| A3 | 3 | 2 mm | 10.51 | 27.2 | 45.9 | 1.88 | 17.2 | C | 0 | 0 | 5 | 3 |
| A4 | 1 | 0.5 mm | 1.99 | 48.1 | 71.9 | 0.854 | 10.8 | C/B | 0 | 0 | 3 | 2 |
| A5 | 2 | 0.5 mm | 6.35 | — | — | — | — | — | | | | |
| A6 | 3 | 0.5 mm | 12.16 | 76.9 | 94.2 | 0.379 | 3.5 | A | 0 | 0 | 0 | 2 |
| B1 | 1 | 2 mm | 4.24 | 6.75 | 14.3 | 6.252 | 76.4 | D | 0 | 0 | 5 | 3 |
| B2 | 2 | 2 mm | 7.04 | — | — | — | — | — | — | — | — | — |
| B3 | 3 | 2 mm | 10.52 | 25.6 | 43.7 | 2.05 | 33 | C/B | 0 | 0 | 3 | 3 |
| B4 | 1 | 0.5 mm | 3.14 | 50.8 | 74.7 | 0.811 | 13 | B | 0 | 0 | 4 | 2 |
| B5 | 2 | 0.5 mm | 6.52 | — | — | — | — | — | — | — | — | — |
| B6 | 3 | 0.5 mm | 13.06 | 82.3 | 95.3 | 0.337 | 3.2 | A | 0 | 0 | 0 | 1 |
| C1 | 1 | 2 mm | 5.61 | 14.2 | 25.5 | 4.913 | 76.4 | D | 0 | 0 | 2 | 2 |
| C2 | 1 | 0.5 mm | 3.65 | 55.9 | 79.2 | 0.703 | 9.8 | B | — | — | — | — |
| C3 | 2 | 0.5 mm | 7.14 | — | — | — | — | — | 0 | 0 | 1 | 0 |
| C4 | 3 | 0.5 mm | 10.63 | 75.8 | 94.2 | 0.388 | 3.5 | A | 0 | 0 | 0 | 0 |
| D1 | 1 | 2 mm | 2.96 | 2.03 | 6.48 | 8.162 | 76.4 | D | — | — | — | — |
| D2 | 1 | 0.5 mm | 3.93 | — | — | — | — | — | — | — | — | — |
| D3 | 2 | 0.5 mm | 7.58 | 51.4 | 74.3 | 0.814 | 9.8 | C/B | — | — | — | — |
| D4 | 3 | 0.5 mm | 11.23 | 73.3 | 92.9 | 0.417 | 4.2 | A | 0 | 0 | 0 | 0 |

An advantageous particle size distribution for the anhydrous LiOH dispersion may be as follows:

Mean size of <1 μm

70% <2 μm

100% <10 μm

In Table 23, the particle size, microscopy and storage stability results for the various $LiOH.H_2O$ dispersions are shown. The sample column indicates the sample composition and milling. The letter indicates the formulation (see, Table 22) and the number indicates the number of passes that the sample has received though the mill.

The results indicate that milling efficiency does not appear to be affected when the base oil is changed from 100N to 330SN. Also, milling efficiency does not appear to be affected when the solid is changed from FMC lithium hydroxide monohydrate to SQM lithium hydroxide monohydrate.

Ignoring the secondary effects due to changes in base oil and source of LiOH, the data from these experiments indicate that even a rapid pass through (residence time of 2 minutes) brings the mean size from several 100 microns to below 10 microns. Prolonged milling only reduces the mean crystal size marginally (to about 2 microns).

The results for the milling with the 0.5 mm beads indicate that:

1. The mean particle size is <1.0 microns after a residence time of 2 minutes, the percent <0.5 microns is about 50% .
2. It is possible to make a very fine dispersion of below 0.5 micron mean size with a residence time of around 10 minutes (of the 0.5 mm beads).

The results indicate that the advantageous milling for $LiOH.H_2O$ (50% solids) in either SN100 or SN330 and 5% surfactant may be as follows:

1. Coarse grind to reduce the large crystals to a mean size of below 10 microns, 90% below 20 microns. On horizontal bead mill this may be achieved in a single rapid pass (residence time of 2-3 minutes).
2. Fine grind to reduce mean size to below 1 micron: This may be achieved by further milling with 0.5 (or 0.7 mm) beads and a residence time of 3-5 minutes. This may yield a dispersion of mean size <1.0 micron and 100% below 5 microns.

It may be possible to achieve the desired particle size distribution by using 1.0 mm beads for 2-4 minute residence time.

The viscosity measurements for the foregoing dispersions are shown in Table 24 below:

TABLE 24

| Sample | Pass No. | Bead diameter | Cumulative time per bead size/ min | Rheometer 250 s-1 (cP) | Brookfield (RVDVE 25° C. spindle #4) cP @ 20 rpm | cP @ 50 rpm |
|---|---|---|---|---|---|---|
| A1 | 1 | 2 mm | 2.34 | 823.0 | 690 | 720 |
| A2 | 2 | 2 mm | 5.75 | — | — | — |
| A3 | 3 | 2 mm | 10.51 | 627.5 | 650 | 636 |
| A4 | 1 | 0.5 mm | 1.99 | 590 | 920 | 664 |
| A5 | 2 | 0.5 mm | 6.35 | — | — | — |

TABLE 24-continued

| Sample | Pass No. | Bead diameter | Cumulative time per bead size/min | Rheometer 250 s-1 (cP) | Brookfield (RVDVE 25° C. spindle #4) cP @ 20 rpm | cP @ 50 rpm |
|---|---|---|---|---|---|---|
| A6 | 3 | 0.5 mm | 12.16 | 540.0 | 1030 | 832 |
| B1 | 1 | 2 mm | 4.24 | 2967 | 2660 | 2692 |
| B2 | 2 | 2 mm | 7.04 | — | — | — |
| B3 | 3 | 2 mm | 10.52 | 2159 | 1960 | 1900 |
| B4 | 1 | 0.5 mm | 3.14 | 1706 | 1610 | 1556 |
| B5 | 2 | 0.5 mm | 6.52 | — | — | — |
| B6 | 3 | 0.5 mm | 13.06 | 1696 | 1700 | 1401 |
| C1 | 1 | 2 mm | 5.61 | 1765 | 1950 | 1844 |
| C4 | 1 | 0.5 mm | 3.65 | 1706 | 1920 | 1900 |
| C5 | 2 | 0.5 mm | 7.14 | — | — | — |
| C6 | 3 | 0.5 mm | 10.63 | 1696 | 1860 | 1804 |

The viscosity of $LiOH.H_2O$ dispersions prepared with 330SN is almost twice that of dispersions prepared with 100N. In general the viscosities fall with reduced milling time with the Brookfield showing a slight increase with the sub-micron dispersions (possibly the onset of surfactant depletion).

Various tests are conducted on the $LiOH.H_2O$ dispersion samples A6, B6 and C4. These are reported in Table 25.

TABLE 25

| Property | Method | Units | A6 | B6 | C4 |
|---|---|---|---|---|---|
| | | Primary Analyses | | | |
| Appearance | Visual | — | ok | ok | Ok |
| Specific Gravity | ASTM D 4052 (at 15° C.) | kg $dm^{-3}$ | 1.107 | 1.1163 | 1.1222 |
| Dynamic Viscosity | Brookfield DVE Spindle No. 4 at 25° C. | cP at 20 rpm | 1030 | 1700 | 1860 |
| | | cP at 50 rpm | 832 | 1401 | 1804 |
| Microscopy (note 3) | | Rating | A pass | A pass | A pass |
| | | Largest/μm | 4.9 | 3.5 | 3.5 |
| TBN (note 1) | | mgKOH/g | 686.15 | 660.1 | 673.4 |
| | | Secondary Analyses | | | |
| Particle Size | Coulter LS230 | % <1.0 μm | 94.2 | 95.3 | 92.9 |
| | | % <0.5 μm | 76.9 | 82.3 | 73.3 |
| | | Mean/μm | 0.379 | 0.337 | 0.417 |
| | | Largest/μm | 3.5 | 3.2 | 4.2 |
| Static Storage | | % oil (4 wk) | 0 | 0 | 0 |
| | | % Sedm (4 wk) | 0 | 0 | 0 |
| N | D5291_MOD | % w/w | 0 | 0 | 0 |
| Pour point | | ° C. | −27 | −21 | −24 |

(note 1)
sample is tested at 20% dilution and calculated back to original sample. Expected TBN for 50% w/w $LiOH{\bullet}H_2O$ is 669 mgKOH/g.

The samples are heated on a laboratory hotplate for 7 hours to remove the water of crystallization. Complete dehydration is confirmed using TGA. A temperature of about 130° C. sustained for 7 hours is sufficient to dehydrate the samples. The results are shown in Table 26.

TABLE 26

| Sample | Pass No. | Bead diameter | Cumulative time per bead size/min | Coulter Ls230 PSA % <0.5 μm | % <1.0 μm | mean | Largest | Microscopy (×400) Rating | 4 wk Storage Stability RT S | RT B | 60° C. S | 60° C. B |
|---|---|---|---|---|---|---|---|---|---|---|---|---|
| A1 | 1 | 2 mm | 2.34 | 13.6 | 24.4 | 4.36 | 76.4 | D/C | 0 | 0 | 6 | 6 |
| A3 | 3 | 2 mm | 10.51 | 56.4 | 74.8 | 0.933 | 47.9 | C | 1 | 1 | 3 | 4 |
| A4 | 1 | 0.5 mm | 1.99 | 86.6 | 94.2 | 0.335 | 4.2 | B | 0 | 0 | 4 | 2 |
| A6 | 3 | 0.5 mm | 12.16 | 100 | 100 | 0.168 | 0.66 | A | 0 | 0 | 4 | 1 |
| B1 | 1 | 2 mm | 4.24 | 20.5 | 34.0 | 4.094 | 194.2 | D | 0 | 2 | 2 | 2 |
| B3 | 3 | 2 mm | 10.52 | 58.3 | 75.8 | 0.915 | 39.8 | D/C | 0 | 0 | 1 | 4 |
| B4 | 1 | 0.5 mm | 3.14 | 100 | 100 | 0.142 | 0.45 | A/B | 0 | 0 | 3 | 3 |
| B6 | 3 | 0.5 mm | 13.06 | 100 | 100 | 0.168 | 0.60 | A | 0 | 0 | 3 | 3 |
| C1 | 1 | 2 mm | 5.61 | 36.9 | 53.5 | 2.66 | 101.1 | C/D | 1 | 0 | 1 | 1 |

TABLE 26-continued

| Sample | Pass No. | Bead diameter | Cumulative time per bead size/ min | Coulter Ls230 PSA % <0.5 μm | % <1.0 μm | mean | Largest | Microscopy (×400) Rating | 4 wk Storage Stability RT S | RT B | 60° C. S | 60° C. B |
|---|---|---|---|---|---|---|---|---|---|---|---|---|
| C2 | 1 | 0.5 mm | 3.65 | 91.0 | 96.0 | 0.3 | 2.0 | B | 0 | 0 | 1 | 1 |
| C4 | 3 | 0.5 mm | 10.63 | 100 | 100 | 0.154 | 0.545 | A | 0 | 0 | 0 | 1 |

The loss of water may give rise to a particle size reduction to 100% <1.0 microns for each final sample. The mean particle size of the final pass samples also decreases from an average of 0.4 microns with the hydrated dispersion to around 0.15 microns for the dehydrated sample.

TABLE 27

| Sample | Pass No. | Bead diameter | Cumulative time per bead size/ min | Rheometer 250 s-1 | Brookfield (RVDVE 25° C. spindle #4) 20 rpm | 50 rpm |
|---|---|---|---|---|---|---|
| A1 | 1 | 2 mm | 2.34 | 479.3 | 460 | 480 |
| A3 | 3 | 2 mm | 10.51 | 346.5 | 330 | 344 |
| A4 | 1 | 0.5 mm | 1.99 | 313.9 | 330 | 340 |
| A6 | 3 | 0.5 mm | 12.16 | 269.4 | 310 | 316 |
| B1 | 1 | 2 mm | 4.24 | 1217 | 1010 | 1044 |
| B3 | 3 | 2 mm | 10.52 | 1250 | 1110 | 1120 |
| B4 | 1 | 0.5 mm | 3.14 | 798.5 | 850 | 856 |
| B6 | 3 | 0.5 mm | 13.06 | 912 | 1010 | 964 |
| C1 | 1 | 2 mm | 5.61 | 1093 | 1060 | 1088 |
| C2 | 1 | 0.5 mm | 3.65 | 1158 | 1120 | 1108 |
| C4 | 3 | 0.5 mm | 10.63 | 1001 | 1000 | 976 |

Viscosity is significantly reduced post dehydration presumably due to the decrease in internal phase volume. After dehydration all dispersions exhibit typical shear thinning behavior. The source of the $LiOH.H_2O$ has a small effect on the dehydrated dispersion viscosity. However, the base oil selection has a greater affect.

Various tests are conducted on the dehydrated samples A6, B6 and C4. these are reported in Table 28.

The above results suggest that dispersion of $LiOH.H_2O$ may be achieved of satisfactory quality using a single pass process. This may involve a sequential milling of the $LiOH.H_2O$ dispersion first through a mill charged with 2 mm beads and then though a second mill in series charged with 0.5 mm beads. An alternative arrangement may be to pass the slurry through a single mill charged with 1.0 mm beads.

EXAMPLE 9

The following particulate size distribution may be advantageous for grease making and for the stability of the dispersion:

Mean size of <1 μm

70% <2 μm

100% <10 μm

A slurry of 50% (w/w) (SQM—the coarser raw material) $LiOH.H_2O$ in 100N oil (45% w/w) and 5% w/w Surfactant F is first passed through the horizontal bead mill charged with 2 mm YtZ beads, and a second time through the mill charged with 0.5 mm beads. The conditions are shown in Table 29. The pump speed varies through the first step on account of the coarseness of the crystals. The following process steps are used:

Step A: Milling for 3 min with 2 mm beads followed by;

Step B: Milling for 2.85 min with 0.5 mm beads followed by;

Step C: Dehydration of the dispersion.

TABLE 28

| Property | Method | Units | A6 | B6 | C4 |
|---|---|---|---|---|---|
| | | Primary Analyses | | | |
| Appearance | Visual | — | Ok | Ok | Ok |
| Specific Gravity | ASTM D 4052 (at 15° C.) | kg $dm^{-3}$ | 1.0272 | 1.0357 | 1.0412 |
| Dynamic Viscosity | Brookfield DVE Spindle No. 4 at 25° C. | cP at 20 rpm | 310 | 1010 | 1000 |
| | | cP at 50 rpm | 316 | 964 | 976 |
| Microscopy (note 3) | | Rating | A pass | A pass | A pass |
| | | Largest/μm | 4.1 | 2.3 | 2.5 |
| TBN (note 1) | | mgKOH/g | 863.9 | 857.8 | 853.0 |
| | | Secondary Analyses | | | |
| Particle Size | Coulter LS230 | % <1.0 μm | 100 | 100 | 100 |
| | | % <0.5 μm | 100 | 100 | 100 |
| | | Mean/μm | 0.168 | 0.168 | 0.154 |
| | | Largest/μm | 0.66 | 0.60 | 0.55 |
| Static Storage | | % oil (4 wk) | 0 | 0 | 0 |
| | | % Sedm (4 wk) | 0 | 0 | 0 |
| N | D5291_MOD | % w/w | 0 | 0 | 0 |
| Pour point | | ° C. | −21 | −18 | −18 |
| PMCC | | ° C. | n/a | 242.2 | n/a |

Note 1, TBN has result is run using a 20% dilution of the dispersion. The expected TBN is 853 mgKOH/g.

TABLE 29

| Step | Bead Ø (mm) | Pass # | Pump setting | Pressure (bar) | Temp mill (° C.) | Temp Chiller (° C.) | Amp mill (Amp) | Flow rate ($cm^3$ $min^{-1}$) | Residence time (min) |
|---|---|---|---|---|---|---|---|---|---|
| A | 2 | 1 | 32-35 | 0.3 | 40-78 | 4-14 | 3.5-4.5 | 100-105 | 3.14-2.99 |
| B | 0.5 | 1 | 35 | 0.2 | 40-65 | 4-10 | 3.5 | 110 | 2.85 |
| | | | | | | | | Total res time 5.84-5.99 min | |

The particle size analyses of the intermediate and final dispersions before and after dehydration are shown in Table 30 below:

TABLE 30

| Step | % < 0.5 μm | % < 1.0 μm | mean/ μm | mode | largest/ μm | peak(s) |
|---|---|---|---|---|---|---|
| A | 11.6 | 19.6 | 8.921 | multi | 176.9 | 10.0, 30.0, 60.0 |
| B | 46.1 | 69.1 | 0.988 | bi | 13 | 0.6, 6.0 |
| C | 85.2 | 92.7 | 0.389 | multi | 13 | 0.2, 2.0, 6.0 |

The storage stability test at room temperature indicates that the coarse milled samples (before and after dehydration) have promising stability showing no free oil or sedimentation after 2 weeks.

EXAMPLE 10

Samples A and B are dispersions containing 50% by weight of $LiOH.H_2O$ of mean particle size of 8.92 and 0.99 microns, respectively. Both of these dispersions are dehydrated to give dispersions C and D. Dispersions C and D contain 36% by weight LiOH particulates of mean particle size 5.5 and 0.4 microns, respectively. The tendency of the dispersions to form sediment is a function OT particle size as illustrated in Table 31 below. The dispersions A and B show the onset of sediment forming at around 2 months. After about 4 months the smaller sized dispersions do not show any sign of a sediment forming.

TABLE 31

| Storage stability tests | | | | | |
|---|---|---|---|---|---|
| $LiOH•H_2O$ | | | LiOH | | |
| Days | A % L | B % L | Days | C % L | D % L |
| 20 | 0 | 0 | 22 | 0 | 0 |
| 44 | 0 | 0 | 39 | 0 | 0 |
| 58 | 0 | 0 | 53 | 0 | 0 |
| 82 | 2 | 1 | 82 | 4 | 0 |
| 106 | 2 | 0 | 106 | 4 | 0 |
| 123 | 8 | 0 | 120 | 10 | 0 |

In Table 31, "L" refers to the formation of a bottom layer of sediment in the sample tube (expressed as % height of the sample tube).

Examples 11-16 disclose grease compositions. Examples 11 and 14, which employ the use of water based solutions of $LiOH.H_2O$, are provided for purposes of comparison.

EXAMPLE 11 (COMPARATIVE EXAMPLE)

To a stainless steel Hobart mixing bowl are added 810 g of 800 sus oil and 96.6 g of Cenwax A (12-hydroxystearic acid). The mixture is heated to 82° C. followed by addition of 14.02 g of $LiOH.H_2O$ dissolved in 56 g of water. The mixture is heated to a temperature in the range of 198° C. to 202° C. over 62 minutes then allowed to cool to 193° C. After further cooling and milling 3 times on a three roll mill, the resulting grease contains 10.85% by weight soap, and has a P0=208, P60=209, and dropping point of 207° C.

EXAMPLE 12

To a stainless steel Hobart mixing bowl are added 810 g of 800 sus oil and 96.6 g Cenwax A. The mixture is heated to 82° C. followed by addition of 23.2 g of 36% LiOH anhydrous dispersion of 846 TBN and 6.66 micron mean particle size as measured with the Coulter LS-230. The mixture is heated to 198° C. to 202° C. over 55 minutes then allowed to cool to 193° C. After further cooling and milling 3 times on a three roll mill, the resulting grease contains 10.7% by weight soap, and has a P0=211, P60=220, and dropping point of 205° C.

EXAMPLE 13

To a stainless steel Hobart mixing bowl are added 810 g of 800 sus oil and 96.6 g Cenwax A. The mixture is heated to 82° C. followed by addition of 29.75 g of 50% $LiOH.H_2O$ dispersion of 646 TBN and 0.34 micron mean particle size as measured with the Coulter LS-230. The mixture is heated to 198° C. to 202° C. over 55 minutes then allowed to cool to 193° C. After further cooling and milling 3 times on a three roll mill, the resulting grease contains 10.7% by weight soap, and has a P0=204, P60=210, and dropping point of 207° C.

EXAMPLE 14 (COMPARATIVE EXAMPLE)

To a stainless steel Hobart mixing bowl are added 810 g of 800 sus oil, 96.6 g Cenwax A and 30.9 g of azelaic acid. The mixture is heated to 82° C. followed by addition of 27.65 g of solid $LiOH.H_2O$ dissolved in 112.2 g of water. The mixture is heated to 148° C. over 75 minutes, held at 148° C. for 30 minutes then heated to 199° C. over 25 minutes. The mixture is allowed to cool to 193° C. After further cooling and milling 3 times on a three roll mill, the resulting grease contains 14.0% by weight soap, and has a P0=222, P60=232, and dropping point of 241° C.

EXAMPLE 15

To a stainless steel Hobart mixing bowl are added 810 g of 800 sus oil, 96.6 g Cenwax A and 30.9 g of azelaic acid. The mixture is heated to 82° C. followed by addition of 58.11 g of 50% $LiOH.H_2O$ dispersion of 646 TBN and 0.34 micron mean particle size as measured with the Coulter LS-230. The mixture is heated to 148° C. over 40 minutes then to 199° C. over 30 minutes. The mixture is allowed to cool to 193° C.

After further cooling and milling 3 times on a three roll mill, the resulting grease contains 13.6% by weight soap, and has a P0=200, P60=209, and dropping point of 292° C.

EXAMPLE 16

To a stainless steel Hobart mixing bowl are added 810 g of 800 sus oil, 96.6 g Cenwax A and 30.9 g of azelaic acid. The mixture is heated to 82° C. followed by addition of 45.5 g of 36% anhydrous LiOH dispersion of 846 TBN and 6.66 micron mean particle size as measured with the Coulter LS-230. The mixture is heated to 148° C. over 40 minutes then to 199° C. over 30 minutes. The mixture is allowed to cool to 193° C. After further cooling and milling 3 times on a three roll mill, the resulting grease contains 13.6% by weight soap, and has a P0=206, P60=213, and dropping point of 260° C.

While the disclosed technology has been explained in relation to certain embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A process for making a dispersion comprising LiOH particulates, the process comprising:

(A) forming a slurry consisting essentially of $LiOH \odot H_2O$ solids and an organic medium, the organic medium comprising at least one oil and at least one surfactant;

(B) milling the slurry in a media mill to form a dispersion comprising $LiOH \odot H_2O$ particulates dispersed in the organic medium;

(C) dehydrating the dispersion to convert the $LiOH \odot H_2O$ particulates to LiOH particulates, (D) mixing $LiOH \odot H_2O$ solids with the dispersion of LiOH particulates formed in (C) to form a dispersion mixture;

(E) milling the dispersion mixture to form a second dispersion comprising LiOH and $LiOH \odot H_2O$ particulates; and (F) dehydrating the second dispersion to convert the $LiOH \odot H_2O$ particulates in the second dispersion to LiOH particulates.

2. The process of claim 1 wherein the slurry is milled during (B) in at least one milling step using media having an average size in the range from about 1.5 to about 2.5 mm and in at least one other milling step using media having an average size in the range from about 0.3 to about 0.8 mm.

3. The process of claim 1 wherein the slurry is milled during (B) in at least one milling step using media having an average size in the range from about 0.8 to about 1.2 mm.

4. The process of claim 1 wherein during (C) the $LiOH \odot H_2O$ particulates are dehydrated using one or more strippers, rotary evaporators, falling film evaporators, thin film evaporators, wiped film evaporators, short path evaporators and/or distillation units.

5. The process of claim 1 wherein the LiOH particulates formed in (C) have a mean particle size in the range up to about 1 micron, and wherein at least about 70% by weight of the LiOH particulates have a particle size in the range up to about 2 microns and at least about 99% by weight of the LiOH particles have a particle size in the range up to about 10 microns.

6. The process of claim 1 wherein the weight ratio of $LiOH \odot H_2O$ solids to LiOH particulates in (D) is in the range from about 9.2:1 to about 0.2:1.

7. A process for making grease comprising:

(A) forming a slurry consisting essentially of $LiOH \odot H_2O$ solids and an organic medium, the organic medium comprising at least one oil and at least one surfactant;

(B) milling the slurry in a media mill to form a dispersion comprising $LiOH \odot H_2O$ particulates dispersed in the organic medium; and (C) dehydrating the dispersion to convert the $LiOH \odot H_2O$ particulates to LiOH particulates, (D) mixing $LiOH \odot H_2O$ solids with the dispersion of LiOH particulates formed in (C) to form a dispersion mixture;

(E) milling the dispersion mixture to form a second dispersion comprising LiOH and $LiOH \odot H_2O$ particulates; and (F) dehydrating the second dispersion to convert the $LiOH \odot H_2O$ particulates in the second dispersion to LiOH particulates mixing the dispersion with at least one carboxylic acid and/or ester thereof and at least one oil of lubricating viscosity, and reacting the LiOH particulates with the carboxylic acid and/or ester thereof sufficiently to thicken the oil of lubricating viscosity to a grease composition.

8. The process of claim 7 wherein the carboxylic acid and/or ester thereof comprises at least one mono-carboxylic acid and/or ester thereof, at least one polycarboxylic acid and/or ester thereof, or a mixture of two or more thereof.

9. The process of claim 8 wherein the at least one polycarboxylic and/or ester thereof comprises at least one dicarboxylic acid and/or ester thereof.

10. The process of claim 9 wherein the ester of the polycarboxylic acid is a diester.

11. A process for making a dispersion comprising of LiOH particulates, the process consisting essentially of:

(A) forming a slurry comprising $LiOH \odot H_2O$ solids and an organic medium, the organic medium comprising at least one oil and at least one surfactant;

(B) milling the slurry in a media mill to form a dispersion comprising $LiOH \odot H_2O$ particulates dispersed in the organic medium;

(C) dehydrating the dispersion to convert the $LiOH \odot H_2O$ particulates to LiOH particulates, (D) mixing $LiOH \odot H_2O$ solids with the dispersion of LiOH particulates formed in (C) to form a dispersion mixture;

(E) milling the dispersion mixture to form a second dispersion comprising LiOH and $LiOH \odot H_2O$ particulates; and (F) dehydrating the second dispersion to convert the $LiOH \odot H_2O$ particulates in the second dispersion to LiOH particulates.

12. A process for making grease consisting essentially of:

(A) forming a slurry comprising $LiOH \odot H_2O$ solids and an organic medium, the organic medium comprising at least one oil and at least one surfactant;

(B) milling the slurry in a media mill to form a dispersion comprising $LiOH \odot H_2O$ particulates dispersed in the organic medium; and (C) dehydrating the dispersion to convert the $LiOH \odot H_2O$ particulates to LiOH particulates, (D) mixing $LiOH \odot H_2O$ solids with the dispersion of LiOH particulates formed in (C) to form a dispersion mixture;

(E) milling the dispersion mixture to form a second dispersion comprising LiOH and $LiOH \odot H_2O$ particulates; and (F) dehydrating the second dispersion to convert the $LiOH \odot H_2O$ particulates in the second dispersion to LiOH particulates mixing the dispersion with at least one carboxylic acid and/or ester thereof and at least one oil of lubricating viscosity, and reacting the LiOH particulates with the carboxylic acid and/or ester thereof sufficiently to thicken the oil of lubricating viscosity to a grease composition.

* * * * *